US007296829B2

(12) United States Patent
Baser

(10) Patent No.: US 7,296,829 B2
(45) Date of Patent: Nov. 20, 2007

(54) DOOR HANDLE ASSEMBLY

(76) Inventor: Owen Baser, 901 Piedmont, Sacramento, CA (US) 95822

( * ) Notice: Subject to any disclaimer, the term of this patent is extended or adjusted under 35 U.S.C. 154(b) by 0 days.

(21) Appl. No.: 11/307,908

(22) Filed: Feb. 27, 2006

(65) Prior Publication Data

US 2006/0152021 A1 Jul. 13, 2006

Related U.S. Application Data

(63) Continuation of application No. 10/816,061, filed on Mar. 31, 2004, now Pat. No. 7,004,518, which is a continuation-in-part of application No. 10/213,135, filed on Aug. 5, 2002, now Pat. No. 6,722,716.

(60) Provisional application No. 60/318,478, filed on Sep. 10, 2001.

(51) Int. Cl.
*E05C 1/12* (2006.01)

(52) U.S. Cl. ..... 292/165; 292/336.3; 292/165

(58) Field of Classification Search ..... 292/137, 292/157, 163–165, 167, 169, 336.3, DIG. 31
See application file for complete search history.

(56) References Cited

U.S. PATENT DOCUMENTS 1,995,338 A * 3/1935 Andrews ..... 70/489
2,655,027 A * 10/1953 Lynxwiler ..... 70/208
2,710,535 A * 6/1955 Quinn ..... 70/150
4,305,609 A * 12/1981 Klay ..... 292/169.17

* cited by examiner

*Primary Examiner*—Gary Estremsky
(74) *Attorney, Agent, or Firm*—Ian F. Burns

(57) ABSTRACT

In at least one embodiment, a door handle assembly is provided comprising a door handle having a roller and attached to a mount. An actuator is attached to the mount and has a first surface and an actuator projection. The door handle assembly also comprises a bolt moveable from a first bolt position where at least a portion of the bolt is inside a wall aperture, thereby engaging the door into the wall aperture, to a second bolt position where the portion of the bolt is outside the wall aperture, thereby disengaging the door from the wall aperture. The bolt has an actuator opening, the actuator passing there through. The roller buts the first surface and may travel from a first roller position to a second roller position when the door handle is pushed, thereby retracting the bolt from the first bolt position to the second bolt position.

15 Claims, 24 Drawing Sheets

DOOR HANDLE ASSEMBLY

CROSS REFERENCE TO RELATED AND CO-PENDING APPLICATIONS

This application is a continuation-in-part of U.S. application Ser. No. 10/816,061, filed Mar. 31, 2004, now issued as U.S. Pat. No. 7,004,518, which is a continuation in part of U.S. application Ser. No. 10/213,135, filed Aug. 5, 2002, now issued as U.S. Pat. No. 6,722,716 issue date Apr. 20, 2004. That application claims the benefit of and incorporates by reference, U.S. provisional application No. 60/318,478, filed on Sept. 10, 2001.

FIELD OF THE INVENTION

The present invention relates to door handle assemblies. More particularly, the present invention relates to low-profile door handle assemblies having door handles actuated by a non-rotational motion.

BACKGROUND

Conventional door handle assemblies typically include a pair of faceplates, a slide bolt, and a pair of door handles. The slide bolt is assembled inside a standard bore of a door so that when the slide bolt extends, it engages the door to an aperture in a wall thereby closing the door and allowing the door to be locked. The standard bore is covered by two opposing faceplates. The door handles protrude from the faceplates.

The height of a conventional door handle is typically 2.25 to 2.50 inches, as measured from a door surface. A conventional door often damages a wall, especially when a door is slammed into a wall. A wall can also be gradually damaged when a conventional door handle often contacts the wall. To minimize wall damage, people use devices, such as doorstops and rubber pads attached to the walls. However, doorstops and rubber pads are not aesthetically pleasing to some people. Doorstops and rubber pads also require additional cost, time, and effort to install. Additionally, doorstops and rubber pads leave permanent marks or holes on the wall when removed. Thus, a door handle that does not cause wall damage is desired.

Another problem with a conventional door handle assembly is it requires rotation of the handle to open a door. Rotating a door handle is difficult at times, particularly when carrying an object with both hands, or particularly when the user is elderly, physically challenged, or has wrist problems. Thus, a door handle assembly that allows a user to open a door without having to rotate the door handle is also desired.

A number of door handles and door handle assemblies are available. U.S. Pat. No. 2,260,74 ('74) discloses a low-profile handle assembly designed for automobiles. The handle assembly has a large disk-like plate. The front face of the disk-like plate is recessed and attaches a crossbar spanning across the recess. The crossbar has an offset projection at one of its ends to provide a finger piece for the handle assembly.

A user would use the finger piece as a crank for raising and lowering the glass panels in windows. A user would also use the finger piece as a handhold or grip for use and assistance in closing the vehicle door. The problem with '74 is it only provides a handhold for opening or closing a door. The handhold does not actuate a lock or a slide bolt.

U.S. Pat. No. 5,085,474 ('474) discloses a latch opener of the push-pull type. '474 has a base plate secured to a door.

A handle is mounted on the base plate to pivot about a first axis. The handle is attached to an actuator. The actuator is mounted on the base plate to pivot about a second axis perpendicular to the first axis. The actuator includes a projecting arm engageable in an opening of a latch bolt housing. When the arm engages a latch bolt, the arm causes the latch bolt to slide and thereby allowing the door to open. The latch bolt housing has a coil spring to continuously bias the latch bolt into a position protruding out of the door thereby allowing the door to close. The problem with '474 is that its handle protrudes in a manner that can cause wall damage. Additionally, its actuator is composed of multiple parts, which makes the actuator susceptible to mechanical malfunction and which makes the actuator expensive to manufacture.

ADVANTAGES OF ONE OR MORE EMBODIMENTS OF THE PRESENT INVENTION

The various embodiments of the present invention may, but do not necessarily, achieve one or more of the following advantages:

provide a low-profile door handle;

provide a door handle substantially flush with a faceplate cover;

provide an attractive door handle;

provide a door handle assembly that opens a door by a non-rotational motion;

provide a door handle assembly that allows a user to open a door easily;

provide a bolt constructed with unitary piece of material;

provide a bolt constructed with minimum machining;

provide a bolt that makes a sturdy and secure door lock;

provide a door handle assembly that is easy to install;

provide a door lock with an emergency access;

provide a door handle assembly with minimal components;

the ability to minimize wall damage from a door handle;

prove a door handle that may be operated with minimal force; and provide a door handle that can be easily pushed to open a door.

These and other advantages may be realized by reference to the remaining portions of the specification, claims, and abstract.

BRIEF SUMMARY OF THE ASPECTS OF THE INVENTION

In at least one embodiment, a door handle assembly is provided comprising a door handle having a roller and attached to a mount. An actuator is attached to the mount and has a first surface and an actuator projection. The door handle assembly also comprises a bolt moveable from a first bolt position where at least a portion of the bolt is inside a wall aperture, thereby engaging the door into the wall aperture, to a second bolt position where the portion of the bolt is outside the wall aperture, thereby disengaging the door from the wall aperture. The bolt has an actuator opening, the actuator passing therethrough. The roller buts the first surface and may travel from a first roller position to a second roller position when the door handle is pushed, thereby retracting the bolt from the first bolt position to the second bolt position.

Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the following drawings where.

DESCRIPTION OF THE PREFERRED EMBODIMENT

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
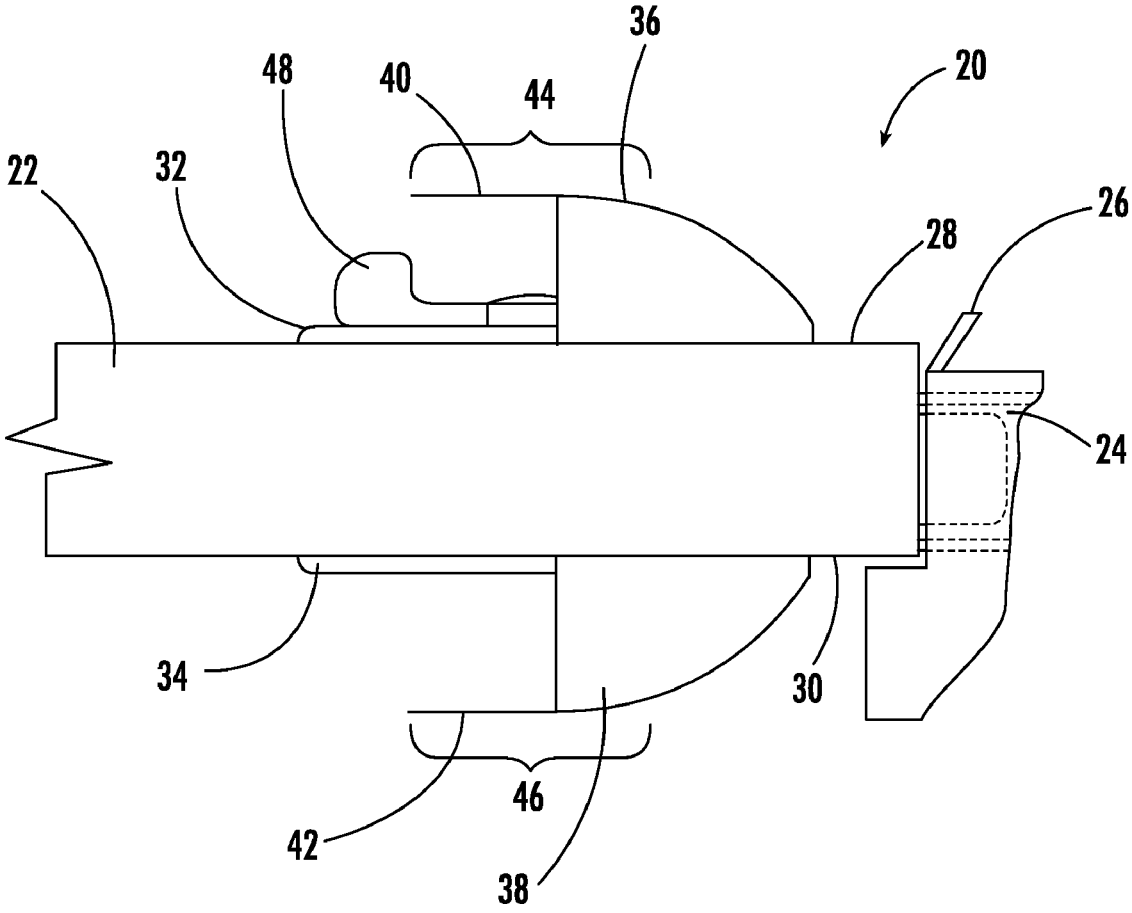
FIG. 1 is substantially a top plan view of one embodiment of the door handle assembly of the present invention being attached to a door, the door handle assembly having a handle and a faceplate cap on each side of the door, and the handle and the faceplate cap on each side of the door defining a substantially flush and a substantially flat surface.

The present invention comprises a door handle assembly, generally indicated by reference number 20. Referring to FIG. 1, door handle assembly 20 is preferably configured to attach to a door 22. Door 22 is engageable to a wall recess 24 preferably covered by a striker plate 26. Door 22 has a front side 28 and a backside 30. Front side 28 is preferably distinguishable from backside 30 by front side 30 being the side to which striker plate 26 protrudes.

In the preferred embodiment, door handle assembly 20 has a pair of opposing faceplates 32 and 34, a pair of opposing faceplate caps 36 and 38 attached to their corresponding faceplates, and a pair of opposing handles 40 and 42. Faceplate cap 36 and handle 40 define a substantially flush and flat surface 44 on front side 28. Faceplate cap 38 and handle 42 define a substantially flush and flat surface 46 on backside 30. In the most preferred embodiment, door handle assembly 20 also has a cam handle 48.

Figure 2:
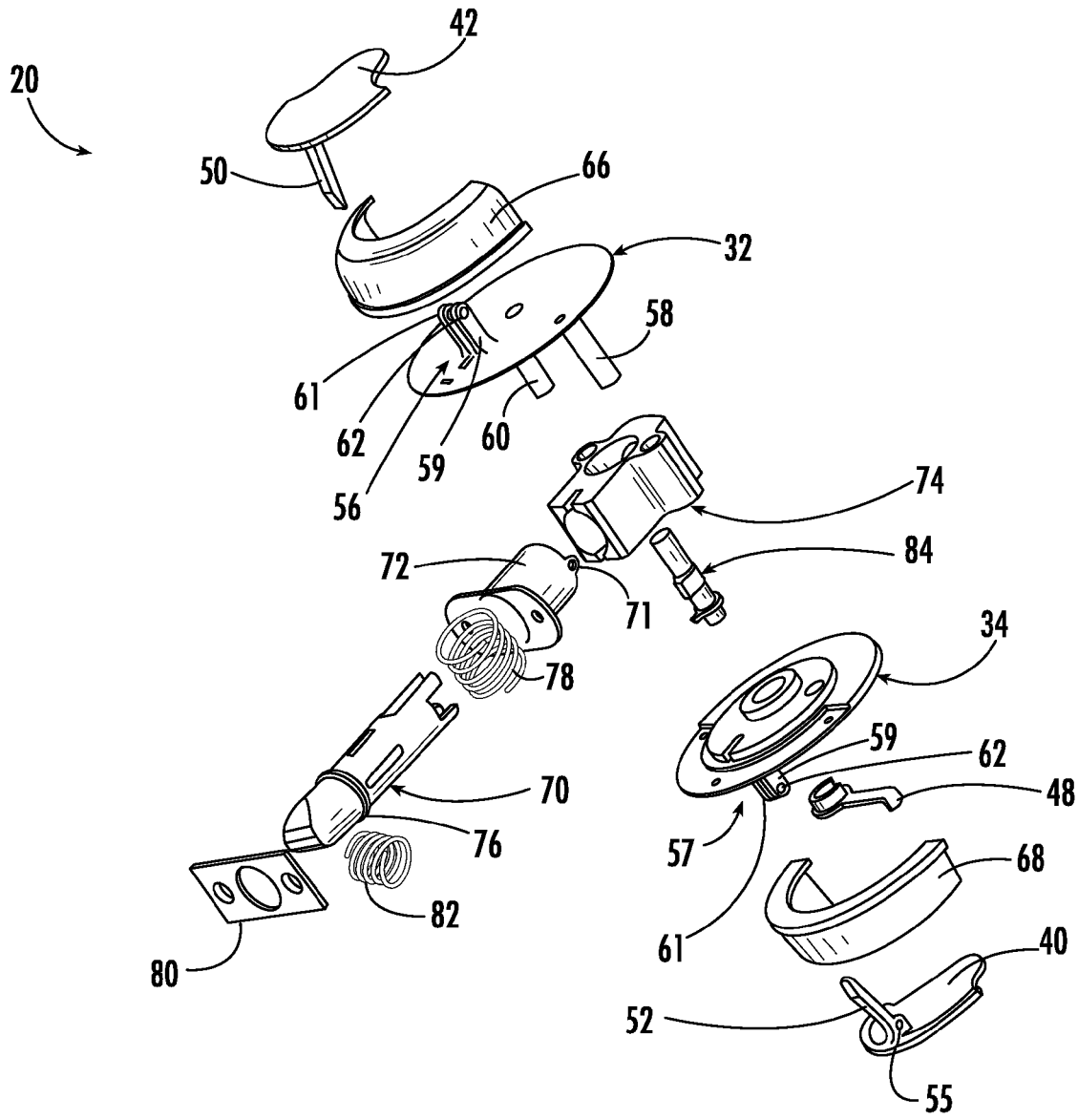
FIG. 2 is substantially an exploded view of one embodiment of the door handle assembly of the present invention.

Referring now to FIG. 2, the preferred embodiment of door handle assembly 20 has an actuator 50 attached to handle 42 and an actuator 52 attached to handle 40. Each actuator 50 and 52 preferably has a pin passage 55 adjacent to its corresponding handle. A fastener (not shown) known in the art may be used to pivotably or rotatably attach actuators 50 and 52 to their corresponding actuator mount 56 and 57.

Actuator mounts 56 and 57 are preferably similar, and they are preferably made of two opposing and parallel projections 59 and 61 being spaced apart. Each actuator mount 56 and 57 preferably has a fastener opening 62 defined by their projections 59 and 61, preferably at the ends of each projections 59 and 61. To attach actuators 50 and 52 to their actuator mounts 56 and 57, respectively, each actuator 50 and 52 is placed in between the parallel projections 59 and 61 of their corresponding actuator mount 56 and 57. A fastener (not shown in FIG. 1) is inserted through fastener opening 61, fastener passage 55, and fastener opening 62.

The ends of parallel projections 59 and 61 of each actuator mounts 56 and 57 that are distal from fastener opening 62 are attached perpendicular to faceplates 32 and 34. Faceplates 32 and 34 are attachable to each other through parallel posts 58 and 60. Faceplate caps 66 and 68 are attached to faceplates 32 and 34, respectively.

Door handle assembly 20 may further have a bolt 70. Bolt 70 is preferably configured to be positioned inside a bolt collar 72. Bolt collar 72 and bolt 70 are preferably configured to be positioned inside a bolt housing 74. Bolt 70 preferably has a bolt ring 76. A first biasing device 78, preferably a spring, may be positioned in between bolt ring 76 and bolt collar 72. Bolt collar 72 is preferably configured to attach to a bolt plate 80 by using fasteners known in the art, such as a screw. A second biasing device 82, preferably a spring, may be positioned in between bolt ring 76 and bolt plate 80. Biasing devices 78 and 80 may also be made of other materials known in the art, such as a coil spring or a tension spring.

Door handle assembly 20 may further have a cam 84 configured to extend across and perpendicular to the planes of faceplates 32 and 34. Cam 84 is further configured to be positioned inside bolt housing 74 and perpendicular to the sliding axis of bolt 70.

Faceplates

Figure 3:
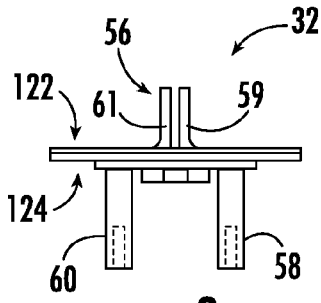
FIG. 3 is substantially an elevational view of one embodiment of a faceplate of the present invention.

Faceplates 32 and 34 are preferably made of zinc metal, but may be made of other materials known in the art such as brass, zinc alloy, or steel. An embodiment of one of the faceplates of door handle assembly 20 is shown in FIGS. 3-6. Faceplate 32 is preferably configured to attach to front side 28 of door 22 (shown in FIG. 1). Referring now to FIG. 3, faceplate 32 has a front side 122 and a backside 124. Front side 122 forms the exterior side of faceplate 32, which is the visible side when faceplate 32 is attached to a door. An actuator mount 56 is attached to front side 122 of faceplate 32. Actuator mount 56 preferably has two parallel projections 59 and 61. Backside 124 forms the interior side of faceplate 32, which will not be visible when faceplate 32 is attached to a door. Faceplate 32 has two parallel posts 58 and 60 attached to backside 55. The ends of posts 58 and 60 that are not directly attached to backside 124 preferably have hollow ends, which may further have threaded interiors to accommodate threaded screws for attaching an opposing faceplate.

Figure 5:
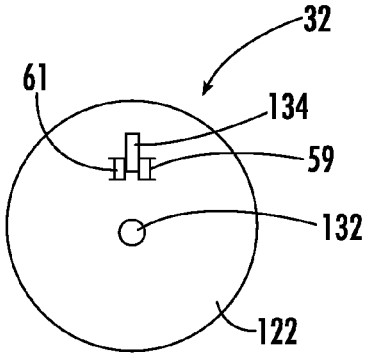
FIG. 5 is substantially a plan view of the front side of the faceplate embodiment shown in FIG. 3.
Figure 4:
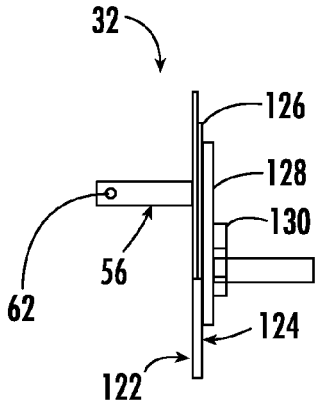
FIG. 4 is substantially a side view of the embodiment of the faceplate shown in FIG. 3.

Referring now to FIG. 4, actuator mount 56 preferably defines a fastener passage 62. Fastener passage 62 allows a pin or a fastener known in the art to attach an actuator to actuator mount 56. As shown also in FIG. 4, backside 124 preferably has three concentric layers 126, 128, and 130. Referring now to FIG. 5, front side 122 has a circular cam opening 132 preferably substantially in the middle of front side 122. Circular cam opening 132 allows cam (not shown in FIG. 5) to attach to faceplate 32.

Figure 6:
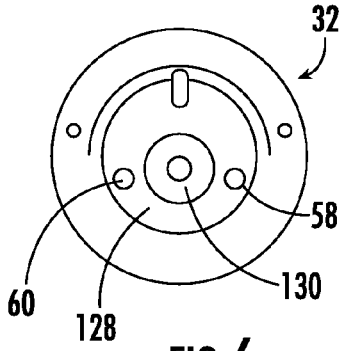
FIG. 6 is substantially a plan view of the backside of the faceplate embodiment shown in FIG. 3.

Front side 122 further has an oblong actuator passage 134. Actuator passage 134 is positioned between parallel projections 59 and 61. Of course, the positions, shapes, and sizes of actuator passage 134 and cam opening 132 may vary. Referring now to FIG. 6, actuator passage 134 preferably extends through layer 128. Posts 58 and 60 are preferably attached on layer 128.

Figure 7:
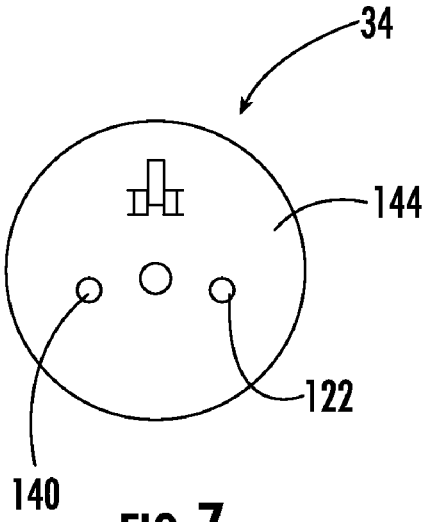
FIG. 7 is substantially a plan view of the front side of another faceplate embodiment.

Another embodiment of faceplate is shown in FIGS. 7-10. Faceplate 34 is preferably configured to attach to back side 30 of door 22 (shown in FIG. 1). Faceplate 34 is preferably similar to faceplate 32 (shown in FIGS. 3-6). However, faceplate 34 preferably does not have posts attached to the backside of the faceplate unlike faceplate 32. Referring to FIG. 7, faceplate 34 preferably has fastener openings 140 and 142 drilled on backside 124 so that when faceplates 32 and 34 are attached to a door, opposing faceplates 32 and 34 are connected by fasteners, such as screws, through fastener openings 140 and 142 of faceplate 34 and posts 58 and 60 of faceplate 32.

Figure 8:
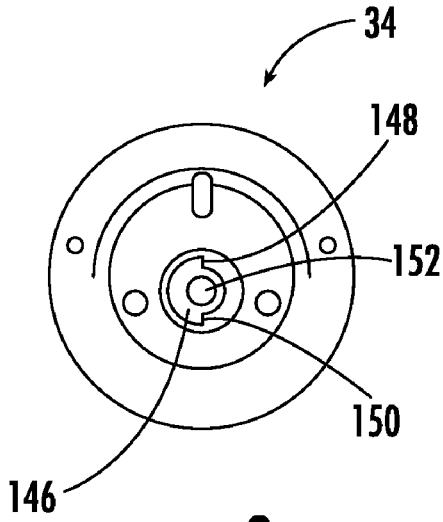
FIG. 8 is substantially a plan view of the backside of the faceplate embodiment shown in FIG. 7.

Referring now to FIG. 8, faceplate 34 also has three concentric layers like faceplate 32. However, in the preferred embodiment, faceplate 34 has an additional fourth layer 146. Fourth layer 146 preferably defines cam stops 148 and 150, and thus fourth layer 146 is preferably circular shaped having a larger radius on one side than the other. Fourth layer 146 preferably further defines a cam opening 152. Cam opening 152 is configured to receive cam 105 (not shown in FIG. 8). When cam 105 (not shown in FIG. 8) attaches to fourth layer 146 through cam opening 152 and rotates, the axis of rotation of cam 105 will be limited by cam stops 148 and 150.

Faceplate Caps

Figure 9:
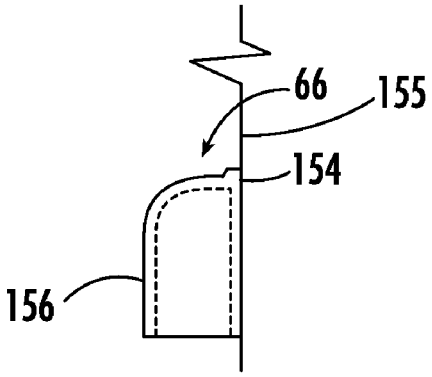
FIG. 9 is substantially a side view of an embodiment of a faceplate cap of the present invention.

Referring now to FIG. 9, an embodiment of a faceplate cap 66 is shown. Faceplate caps 66 and 68 (shown in FIG. 1) are preferably similar. Faceplate cap 66 is preferably made of zinc metal, but may be made of other materials known in the art, such as brass, zinc alloy, or steel. Faceplate cap 66 has preferably a hemisphere shape further cut crosswise by a half. Faceplate cap 66 has a backside 154 and a front side 156. The preferred distance from backside 154 and front side 156 is equal to or less than 1 inch. When measured from a door surface 155, the preferred height of faceplate cap 66 is equal to or less than 1 inch. Of course, the faceplate cap may be made with varying dimensions.

Figure 10:
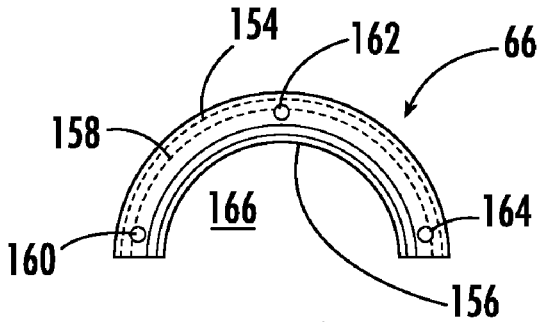
FIG. 10 is substantially a plan view of the faceplate cap embodiment shown in FIG. 9.

As shown in FIG. 10, backside 154 preferably has flat base 158 configured to attach to a faceplate (not shown in FIG. 10). Flat base 158 preferably has three openings 160, 162, and 164 for fasteners, such as screws, to attach faceplate cap 66 to a faceplate (not shown in FIG. 10). Of course, flat base 158 may be attached to a faceplate by welding, by using an adhesive, or other techniques known in the art. Front side 156 preferably defines a semi-circular recess 166, which accommodates handle 40 or 42 (not shown in FIG. 10). Front side 156 and handle 40 or 42 forms a substantially flat surface (not shown in FIG. 10).

Figure 11:
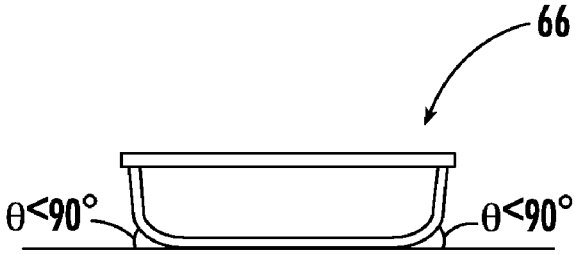
FIG. 11 is substantially a cross-sectional view of the faceplate cap embodiment shown in FIG. 9 with the front side being on the bottom and the backside being on top.

Faceplate cap 66 may be made of shapes other than a hemisphere that is further cut by a half. Faceplate cap 66 may be in the shape of an entire hemisphere, a hemisphere cut by more than or less than a half, or some portion of a sphere cut crosswise by exactly a half, more than a half, or less than a half. As shown in FIG. 11, when faceplate cap 66 is laid on a flat surface with front side 58 on the bottom and backside 56 on top, the edges of front side 58 forms substantially an acute angle measured from the flat surface.

Door Handles and Actuator

Figure 12:
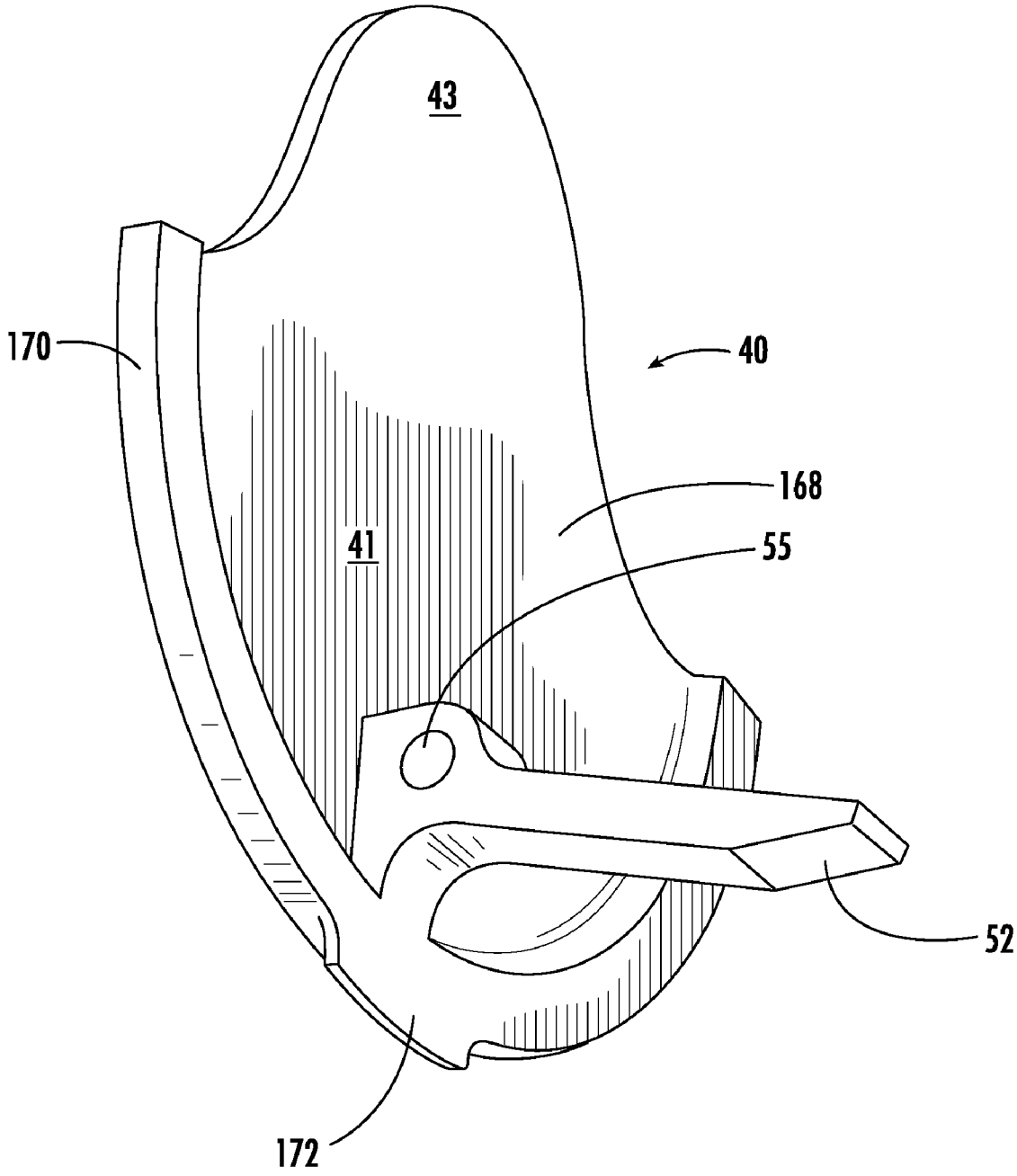
FIG. 12 is substantially a perspective view of an embodiment of a door handle and an actuator of the present invention.

Referring now to FIG. 12, a handle 40 with an attached actuator 52 is shown. Handle 42 shown in FIG. 2 is preferably similar to handle 40. Actuator 52 shown in FIG. 2 is preferably similar to actuator 50. Handle 40 has a front surface (not shown in FIG. 12) and a back surface 168. Handle 40 preferably has a semi-circular shaped half 41. The other half of handle 40 is preferably a substantially c-shaped half 43, wherein the ends of the "c" are smoothly connected to semi-circular shaped half 41. C-shaped half 43 allows a user to easily grasp and pull handle 40.

Semi-circular shaped half 41 preferably has raised edges 170 to add more definition to handle 40. Handle 40 preferably has a pivot stop 172 attached in the middle of raised edge 170 of semi-circular shaped half 41 and adjacent to back surface 168. Pivot stop 172 may be made of various shapes. Pivot stop 172 preferably protrudes from raised edge 170 and is preferably parallel to the plane of raised edge 170. Pivot stop 172 restricts the pivot movement of handle 40.

When handle 40 is attached on actuator mount 56 (not shown in FIG. 12) and adjacent to faceplate cap 66 (not shown in FIG. 12), handle 40 and faceplate cap 66 are preferably configured to form a substantially flush and substantially flat front surface.

Actuator 52 is preferably attached on backside 168 of handle 40 and perpendicular to handle 40. Actuator 52 is preferably positioned adjacent to the middle of the rounded edge of semi-circular half 41 of handle 40. Actuator 52 preferably defines pin passage 55 adjacent to the end of actuator 52 that is adjacent to handle 40. The opposite end of actuator 52 that is away from handle 40 is preferably tapered on one side to allow for better positioning of actuator 52 inside actuator passage of bolt 70 (not shown in FIG. 12).

Handle 40 and actuator 52 are preferably made of zinc, but may be made with other materials known in the art, such as steel, zinc alloy, and brass. In the preferred embodiment, handle 40 and actuator 52 are unitarily built. However, handle 40 and actuator 52 may also be attached through welding or through an adhesive. Handle 40 and actuator 52 may further be attached using fasteners known in the art.

Bolt

Figure 13:
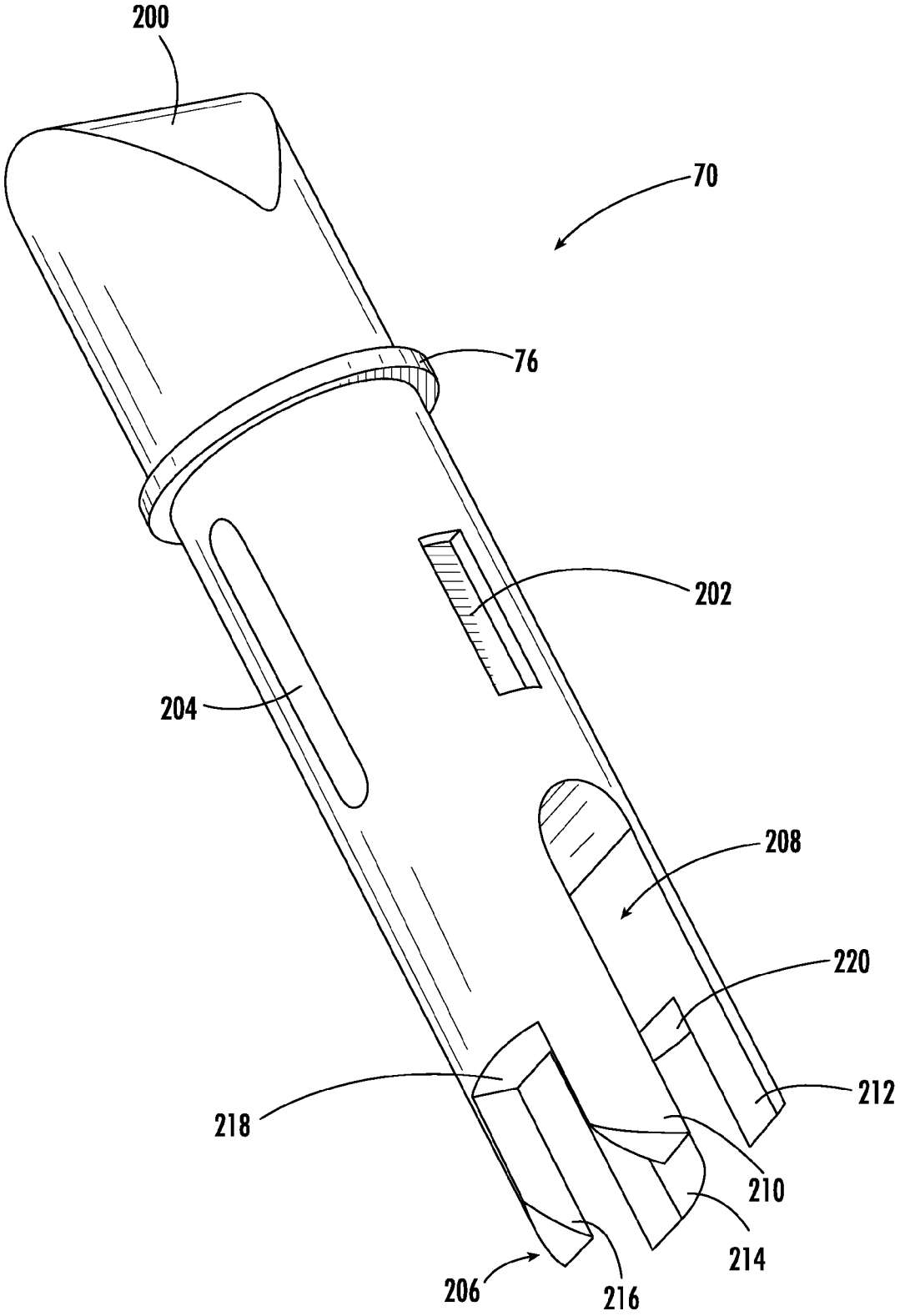
FIG. 13 is substantially a perspective view of an embodiment of a bolt of the present invention.

Referring now to FIG. 13, a preferred embodiment of bolt 70 is shown. In the preferred embodiment, bolt 70 partially tapers toward a first end 200. First end 200 is configured to insert through a wall aperture to engage and close a door. First end 200 is tapered so that when first end 200 is in contact with a striker plate surrounding a wall aperture (not shown in FIG. 13), first end 200 slides past striker plate, and first end 200 slides towards inside the wall aperture. First end 200 is also tapered to allow bolt 70 to move outside the wall aperture quicker when the door is opened.

In the preferred embodiment, bolt 70 also has a pin opening 204. One end of a pin (not shown) may be inserted inside pin opening 204 and the other end of pin may be attached to a pin opening 71 of bolt collar 72 (shown in FIG. 2), and thus the pin prohibits substantial rotational movement of bolt 70. Prohibiting substantial rotational movement of bolt 70 may allow proper actuator positioning inside actuator opening 202, which translates to proper operation of actuators 52 and 50 (not shown in FIG. 13).

In the preferred embodiment, bolt 70 has a ring 76. Ring 76 provides an abutting surface for biasing devices 78 and 82 (shown in FIG. 2) so that biasing devices 78 and 82 can operate to cause bolt 70 to slide back and forth in a sliding axis thereby allowing bolt to engage and disengage a door from a wall aperture. Bolt 70 has a second end 206, which is opposite first end 200. Bolt 70 defines a cam aperture 208 adjacent to the second end. Cam aperture 208 is configured to accommodate cam 105 (not shown in FIG. 13) positioned perpendicular to bolt 70. At the second end, bolt 70 has a plurality of fingers 210, 212, 214, and 216. Fingers 210, 212, 214, and 216 define a pair of stop surfaces 218 and 220 for a cam portion (not shown in FIG. 13) to abut to prevent bolt from sliding in its sliding axis.

Bolt 70 is preferably made of zinc, but may also be made of materials known in the art, such as zinc alloy, steel, and brass. Bolt 70 is preferably unitarily constructed. Bolt 70 may unitarily be constructed by molding or other techniques known in the art. A unitarily constructed bolt 70 provides a sturdier and thus more secure lock than a bolt made of multiple components. A lock provided by a bolt made of multiple components may easily be tampered. For example, if one component gives in to the tampering or if the component bends or breaks, the remaining components may lose the support provided by the component that gave in. In contrast, for a lock supported by a unitarily constructed bolt to be tampered, the entire bolt has to be destroyed. Since bolt 70 is usually positioned inside a standard bore of a door, tampering with bolt 70 may require destruction of the entire door.

Bolt Housing

Figure 14:
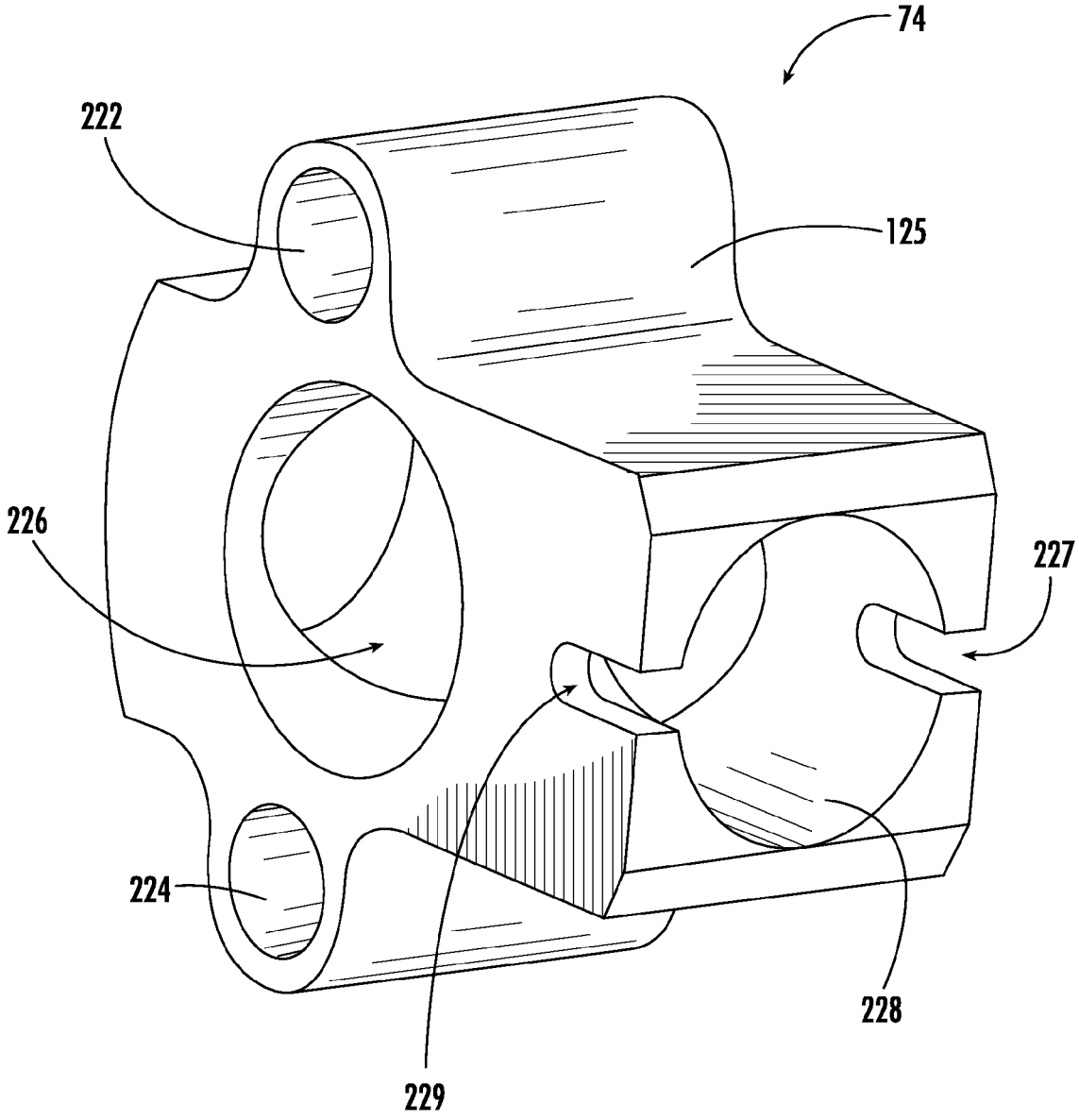
FIG. 14 is substantially a perspective view of an embodiment of a bolt housing of the present invention.

Referring now to FIG. 14, an embodiment of a bolt housing is shown. Bolt housing 74 preferably defines post passages 222 and 224. Post passages 222 and 224 are designed to receive posts 58 and 60 of faceplate 32 (not shown in FIG. 14). Bolt housing 74 further defines a cam passage 226 in between post passages 222 and 224. Cam passage 226 is designed to allow cam 105 (not shown in FIG. 14) to extend between faceplates 32 and 34 (also not shown in FIG. 14). Next, bolt housing 74 defines a bolt passage 228 to allow bolt 70 (not shown in FIG. 14) to pass through and meet with cam 105 (also not shown in FIG. 14). Bolt housing 74 further defines actuator slots 227 and 229 to allow actuators 50 and 52 (not shown in FIG. 14) to pass through and engage bolt 70 (not shown in FIG. 14).

Actuation

Figure 15:
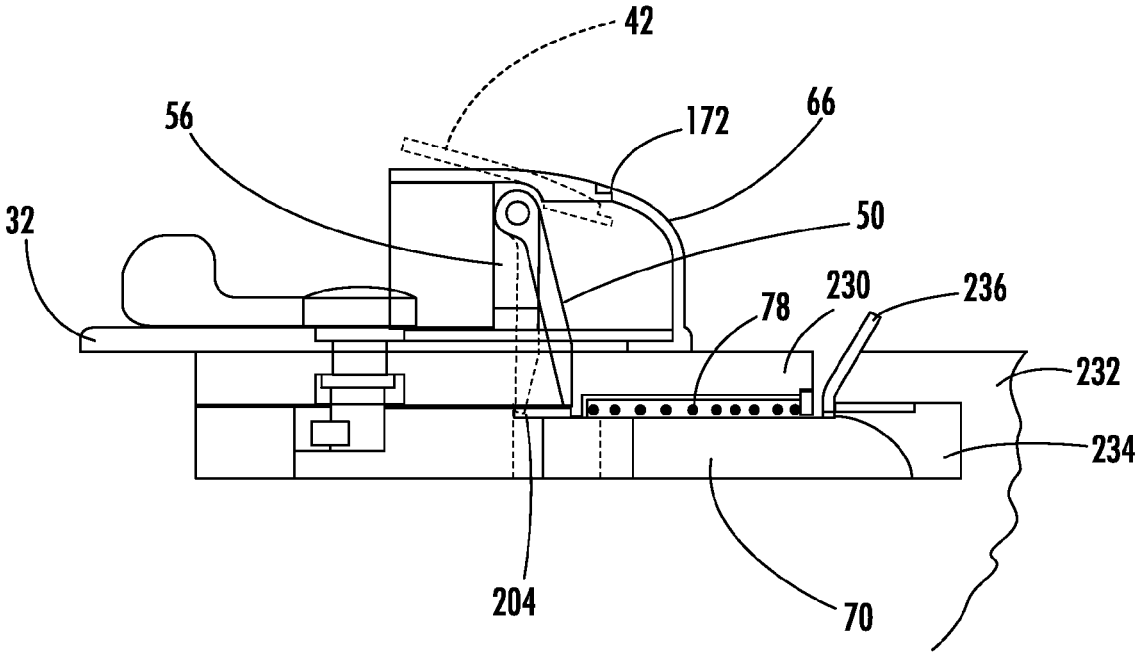
FIG. 15 shows substantially one method of opening a door or disengaging a door from a wall, wherein a handle actuates an actuator and the actuator engages a bolt to slide the bolt away from a wall aperture.

Referring now to FIG. 15, biasing device 78 preferably urge bolt 70 to a first position wherein bolt 70 is configured to protrude from a door 230 and to engage door 230 with a wall 232 by moving into wall aperture 234 surrounded by a striker plate 236. Door handle 42 is attached to actuator 50. Actuator 50 extends through actuator passage (not shown in FIG. 15) of faceplate 32 and through actuator opening 202 to engage bolt 70. Door handle 42 and actuator 50 are attached on actuator mount 56, which serves as a fulcrum allowing handle 42 and actuator 50 to pivot around a pivot axis.

As a user opens door 230, the user holds handle 42 and pulls handle 42 toward him or her. Handle 42 and actuator 50 pivots around the fulcrum provided by actuator mount 56. Actuator 50 moves bolt 70 to a second position wherein bolt 70 moves outside wall aperture 234 thereby disengaging door 230 from wall 232. After the user releases door handle 42, biasing device 78 naturally urges bolt 70 to protrude from door 230 thereby causing door handle 42 to move to a position wherein door handle 42 and faceplate cap 66 defines a substantially flush and substantially flat front surface. Pivot stop 172 of door handle 42 abuts faceplate cap 66 to maintain a substantially flush and substantially flat front surface.

Cam

Figure 16:
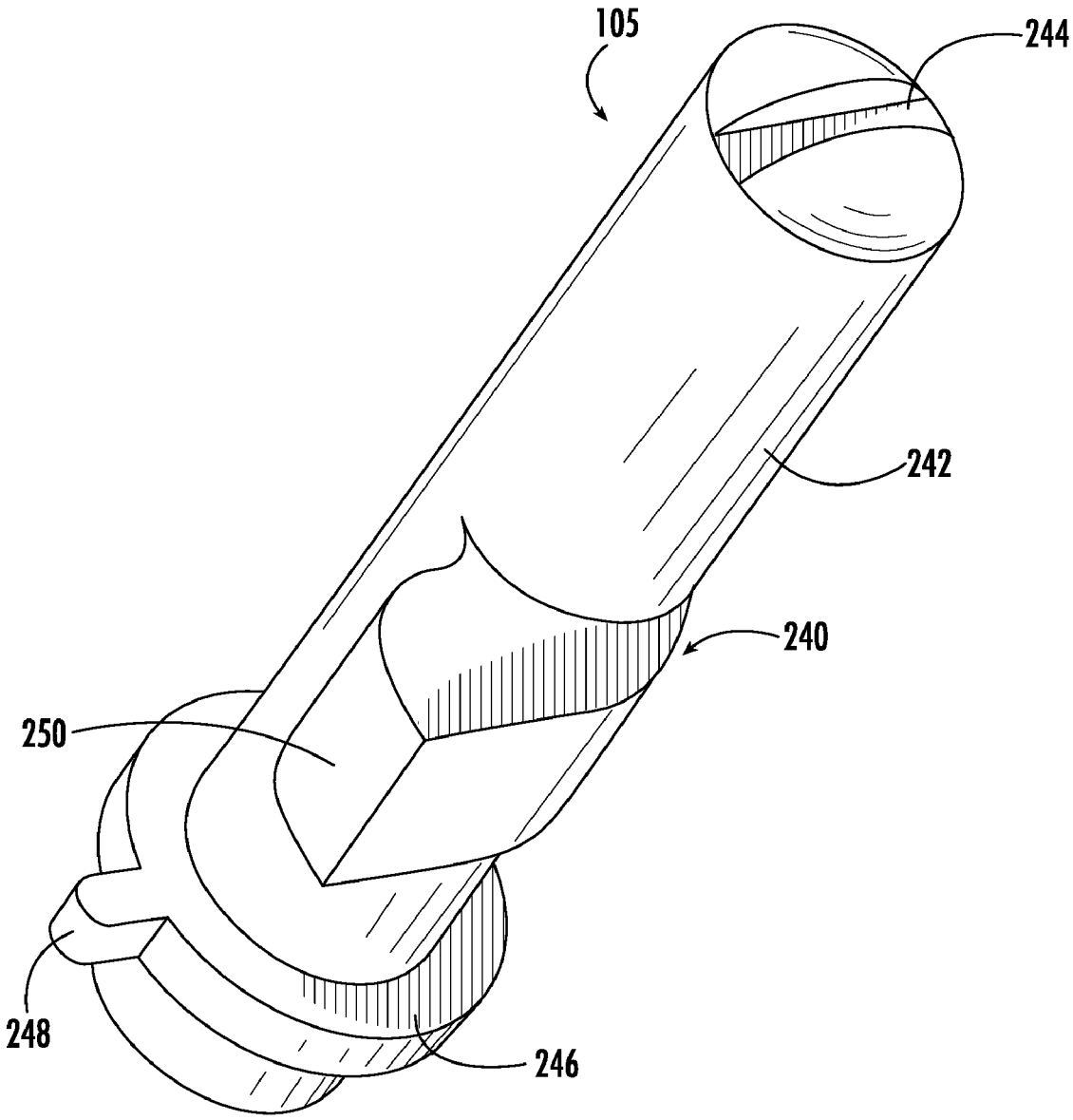
FIG. 16 is substantially a perspective view of an embodiment of a cam of the present invention, the cam being attached to a cam shaft, the cam shaft having a depression to receive a cam actuator, and the cam shaft further having a cam rotation stop to limit the rotation of the cam.

Referring now to FIG. 16, a preferred embodiment of cam 105 has a cam portion 240 attached to a camshaft 242. Cam portion 240 is preferably shaped to fit cam aperture 208 of bolt 70. Cam portion 240 preferably has a raised abutting portion 250 to abut stop surfaces 218 and 220 of bolt 70 (not shown in FIG. 16) and prevent bolt from sliding away from wall aperture thereby locking the door. Cam 105 further has a cam ring 246 and a ring projection 248 transverse from cam ring 246. Ring projection 248 preferably cam stops 148 and 150 (shown in FIG. 8) when cam 105 rotates around its axis of rotation to limit rotation of cam 105.

In the most preferred embodiment, an alternate cam access 244 is positioned at one end of camshaft 242. Alternate cam access 244 is preferably a depression spanning crosswise across the end of camshaft. The depression is preferably sized to fit a flathead screwdriver or a key so that a flathead screwdriver or a key may be used as alternative devices to a cam latch (not shown in FIG. 16) to actuate cam 105.

Locking Mechanism

Figure 17:
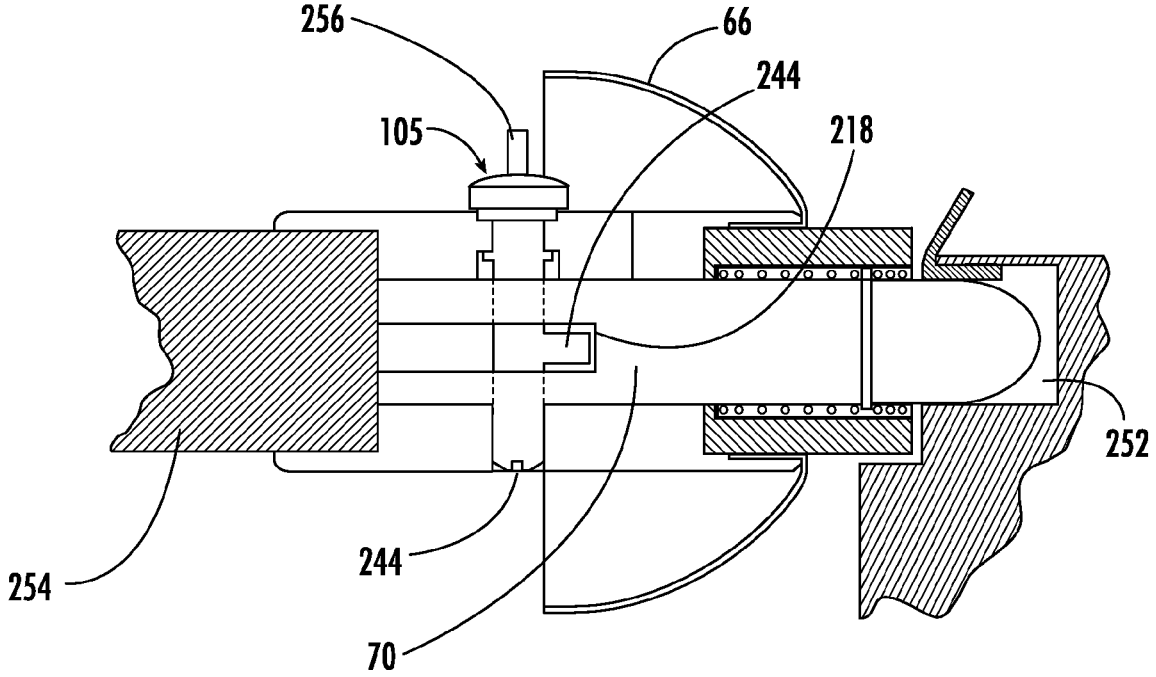
FIG. 17 is substantially an embodiment of a locking mechanism of the present invention, wherein the cam shown in FIG. 16 is in a locked position and the bolt may slide away from the wall aperture to allow the door to open.

Referring now to FIG. 17, a cam latch 256 may be attached to cam 105, which may allow a user to conveniently activate cam 105. By pivoting cam latch 256 within a rotational axis, cam latch 256 moves cam 105 between first and second positions discussed below. Cam latch 256 may be positioned on the side of faceplate 32 where actuator mount 56 (not shown in FIG. 17), faceplate cap 66, and door handle (not shown in FIG. 17) are attached for easy access by the user. Cam 105 may also have alternative cam access 244 to allow a user to use screwdrivers, keys, and the like to access cam from to move cam 105 between first and second positions discussed below.

Cam 105 is preferably positioned perpendicular to bolt 70 and in between fingers 210, 212, 214, and 216 of bolt 70 (not shown in FIG. 17). Cam 105 is configured to be moveable to a first position where raised abutting portion 244 of cam 105 abuts stop surfaces 218 and 220 of bolt 70 (only one stop surface is shown in FIG. 18) thereby preventing bolt 70 from sliding away from a wall aperture 252 and preventing a door 254 from opening.

Figure 18:
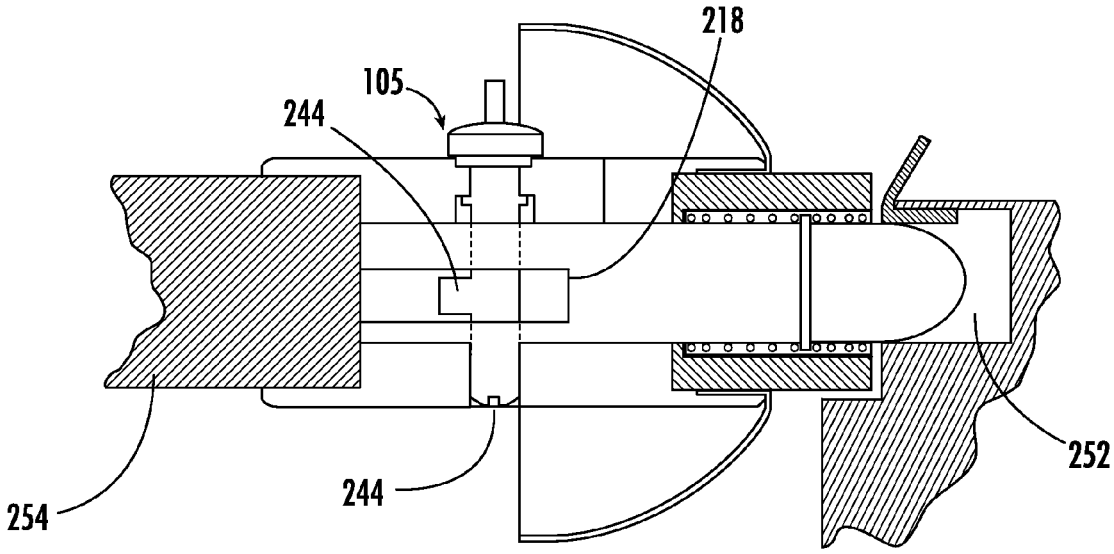
FIG. 18 is substantially the locking mechanism embodiment shown in FIG. 17, wherein the cam is in an unlocked position, and the cam prevents the bolt from sliding away from the wall aperture thereby preventing the door from being opened.

Referring now to FIG. 18, cam 105 may also be movable to a second position wherein raised abutting portion 244 of cam 105 does not abut stop surfaces 218 and 220 of bolt 70 thereby allowing bolt 70 to slide towards a second position wherein bolt 70 is away from wall aperture and thereby allowing door 254 to open.

Closet Door Assemblies

Figure 19:
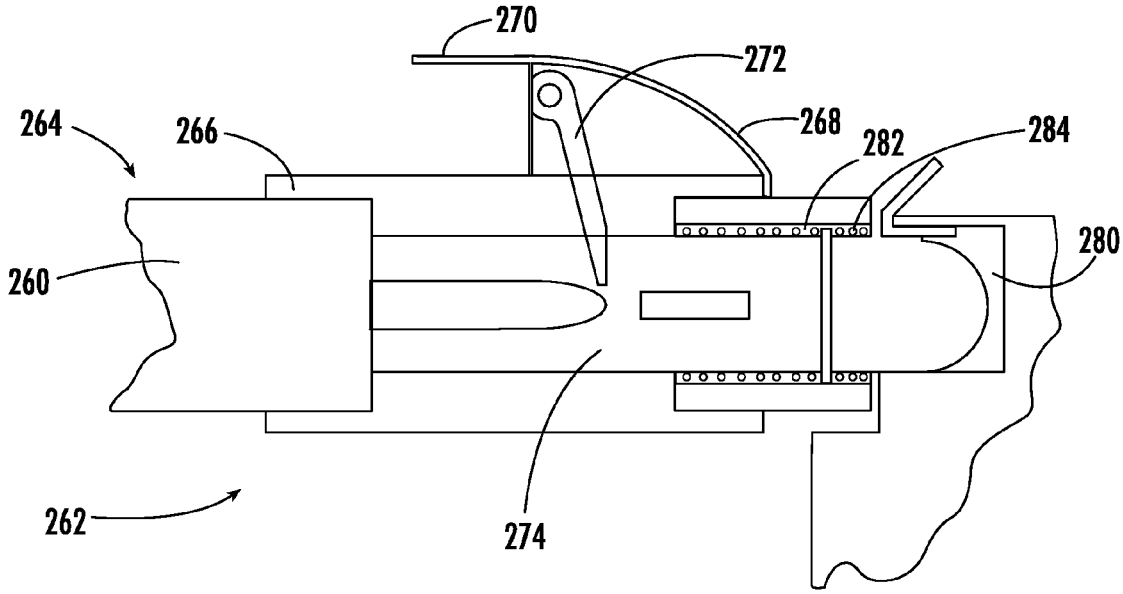
FIG. 19 is substantially an embodiment of the door handle assembly wherein the door may only be opened by using the door handle positioned only on one side of the door.

Referring now to FIG. 19, a door handle assembly of an alternative embodiment is shown. The door handle assembly shown in FIG. 19 may be suited for doors that need not be locked or for doors that only need to be opened from one side. As an example, the door handle assembly may be suited for hall closet doors commonly found in residences. A hall closet door provides access to a relatively small area, which is usually a storage area designated for storing coats and jackets. A hall closet door usually does not lock, and it usually has only one door handle.

Door 260 has a storage side 262, which preferably faces the storage area and a user side 264 opposite the storage area. The door handle assembly has at least a faceplate 266 attached to user side 264. A faceplate cap 268 with an attached handle 270 is preferably attached to faceplate 266. An actuator 272 is attached to handle 270. Actuator 272 and handle 270 are mounted to and may pivot around an actuator mount (not shown in FIG. 19). A portion of actuator 272 is positioned inside an actuator passage (not shown in FIG. 19) of bolt 274.

Biasing devices 282 and 284 urges bolt 274 to move inside a wall aperture 280 thereby closing door 260. To open door 260, actuator 272 may be actuated to move bolt 274 away from wall aperture 280 thereby releasing door 260 from wall aperture 280.

Passage Door Assemblies

Figure 20:
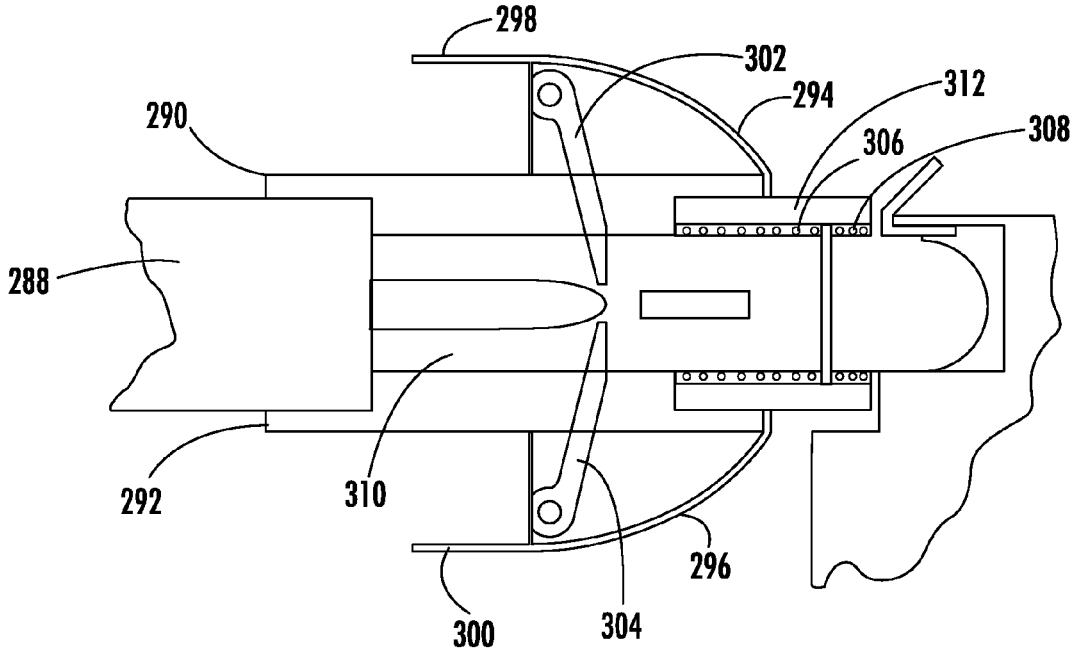
FIG. 20 is substantially another embodiment of the door handle assembly wherein the door may be opened by using the door handles positioned on both sides of the door.

Referring now to FIG. 20, another embodiment of the door handle assembly is shown. The door handle assembly shown in FIG. 20 may be suited for doors that need not be locked and for doors that mainly partition rooms. Additionally, as hall closet doors for people with children, the door handle assembly shown in FIG. 20 may be preferred over the door handle assembly of FIG. 19 because the door handle assembly of FIG. 20 allows the children to open the door from the inside of the closet, and thus eliminates the risk of children being locked inside the hall closet. The door handle assembly shown in FIG. 20 preferably primarily provides passage between rooms, and thus may be opened by using the door handles positioned on both sides of the door.

The door assembly of the embodiment shown in FIG. 20 preferably has opposing faceplates 290 and 292 attached on each side of door 288, faceplate caps 294 and 296 attached to each opposing faceplates 290 and 292, actuator mounts (not shown in FIG. 20) attached to each opposing faceplates 290 and 292, and door handles 298 and 300 with corresponding actuators 302 and 304 connected to actuator mounts. Additionally, the door assembly of the embodiment shown in FIG. 20 preferably has biasing devices 306 and 308, bolt 310, bolt collar 312, and bolt plate (not shown in FIG. 20).

Lockable Door Asssemblies

Figure 21:
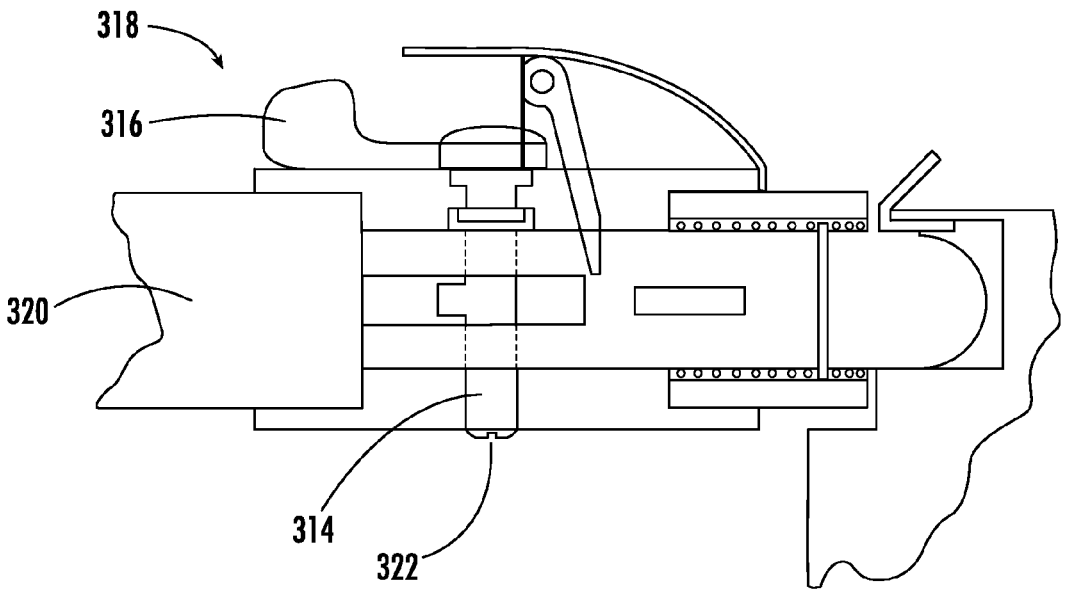
FIG. 21 is substantially another embodiment of the door handle assembly, wherein the door may only be opened by using the door handle positioned only on one side of the door, wherein the door may be locked and unlocked using the cam latch positioned on the same side of the door as the door handle, and wherein the door may be locked and unlocked by actuating cam through an alternate cam access.
Figure 22:
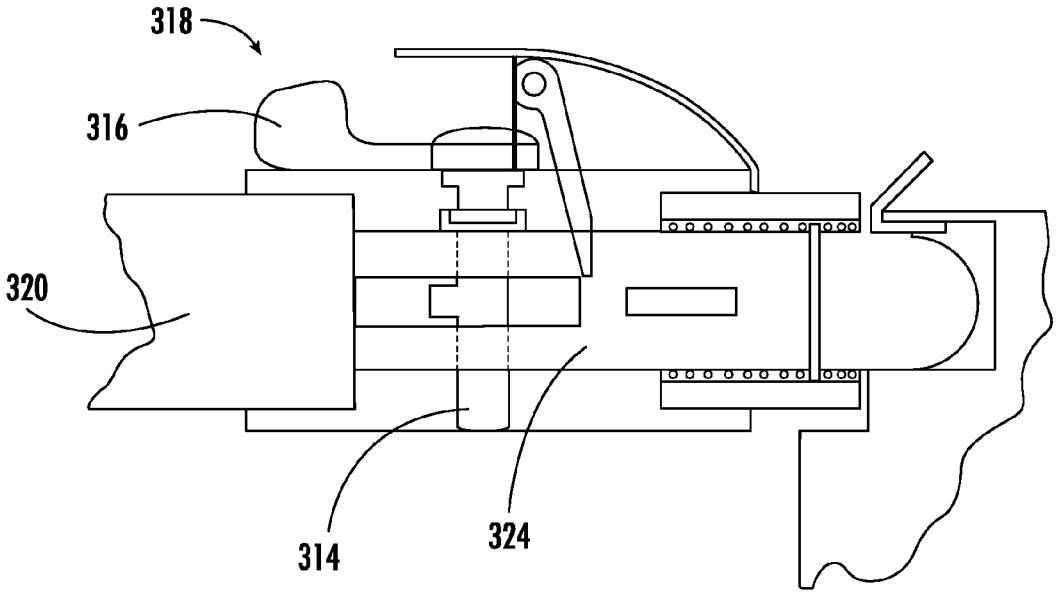
FIG. 22 is substantially another embodiment of the door handle assembly, wherein the door may only be opened by using the door handle positioned only on one side of the door, and wherein the door may be locked and unlocked using the cam latch positioned on the same side of the door as the door handle.
Figure 23:
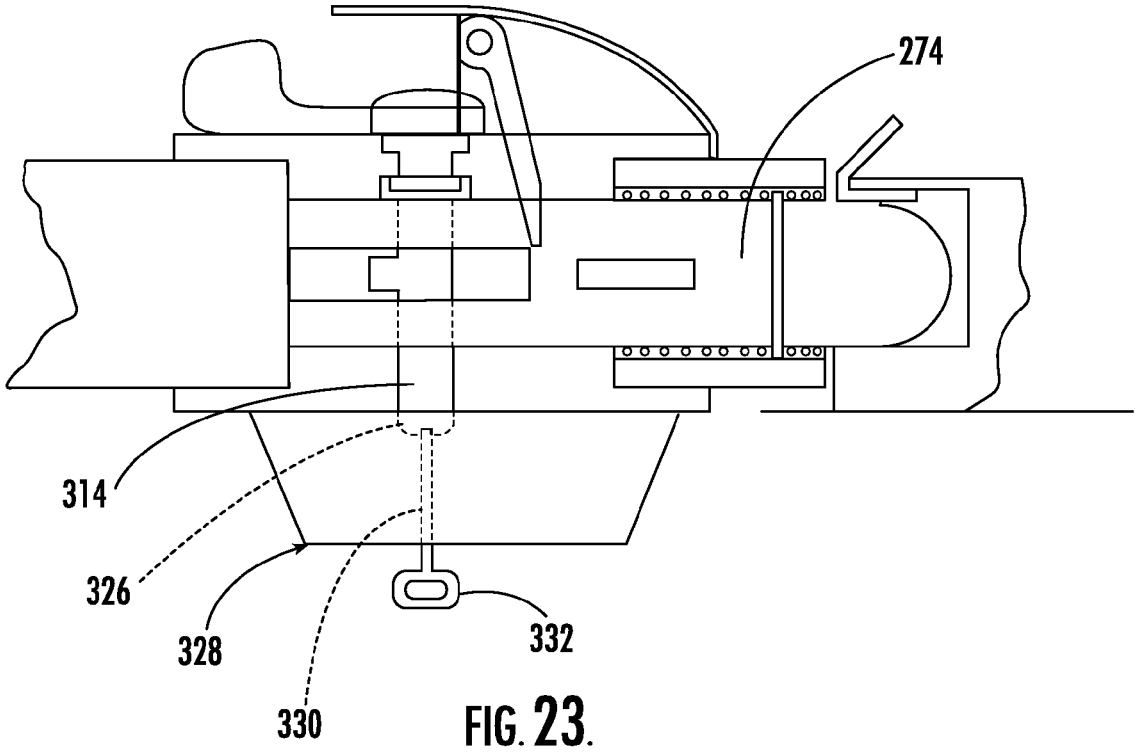
FIG. 23 is substantially another embodiment of the door handle assembly, wherein the door may only be opened by using the door handle positioned only on a first side of the door, wherein the door may be locked and unlocked using the cam latch positioned on the same side of the door as the door handle, and wherein the door may be locked and unlocked by using a key from a second side of the door.

FIGS. 21-23 show additional door handle assembly embodiments. These door handle assembly embodiments may be suited for doors that are desired to be lockable for privacy or security purposes.

Referring now to FIG. 21, the door handle assembly preferably has the same components as the embodiment shown in FIG. 19. Additionally, the door handle assembly of FIG. 21 has a cam 314 described in FIGS. 17 and 18 above. A cam latch 316 may be positioned on one end of cam 314, preferably on the end of cam 314 that is facing a private or secured side 318 of door 320. Side 318 is preferably the side a user desires to prevent or limit access to for privacy or security reasons. Opposite to side 318, cam 314 has an alternate cam access 322 similar to alternate cam access 244 described in FIGS. 17 and 18. Alternate cam access 322 may be used to as an alternate access for unlocking door 320.

Referring now to FIG. 22, the door handle assembly preferably has similar components described in FIG. 21. The door handle assembly embodiment of FIG. 22 preferably does not have an alternate cam access of FIG. 22. Additionally, bolt 324 may have a greater length than the bolt described in FIG. 13.

Referring now to FIG. 23, the door handle assembly preferably has similar components described in FIG. 21. The door handle assembly embodiment of FIG. 23 preferably has an alternate cam access 326 similar to alternate cam access 244 described in FIGS. 17 and 18. An alternate faceplate cap 328 preferably covers alternate cam access 326. Alternate faceplate cap 328 is preferably cylindrical and has a key recess 330 spanning across its vertical axis. A key 332 may be used to actuate cam 314 to lock and unlock bolt 274. Alternate faceplate cap 328 may be made of zinc, brass, or other materials known in the art.

Figure 24:
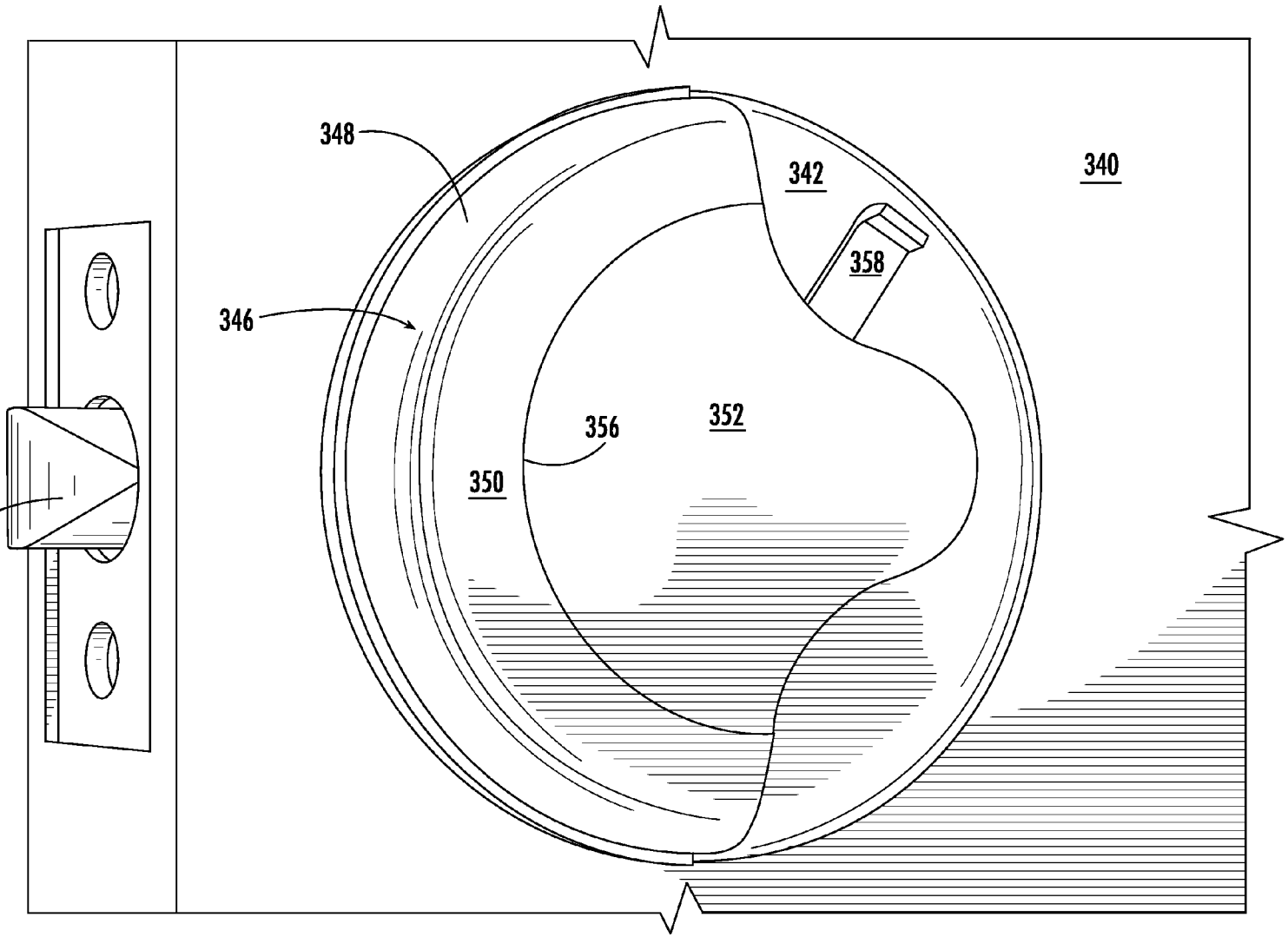
FIG. 24 is substantially perspective view of a door having an embodiment of the door handle assembly attached, the perspective view also showing the low-profile characteristic and non-rotational actuation feature of the door handle.

Referring now to FIG. 24, a preferred embodiment of a door handle assembly has a faceplate 342 attached to a door 340. A faceplate cap 346 is attached to faceplate 342. Faceplate cap 346 has a vertical portion 348 and a horizontal portion 350. Horizontal portion 350 and door handle 352 defines a substantially flat surface 354. Horizontal portion 350 and door handle 352 are further substantially flush, which means horizontal portion 350 and door handle 352 form a substantially continuous plane or substantially unbroken surface except for a boundary 356 between horizontal portion 350 and door handle 352. Door handle assembly may further have a cam latch 358 behind door handle 352.

Door 340 may be opened by pulling handle 352. Handle 352 may be moved around a pivot axis on a horizontal plane. As handle 352 moves around pivot axis, actuator (not shown in FIG. 24) engages bolt 360 and causes bolt 360 to slide within in its sliding axis. Sliding axis of bolt 360 is preferably parallel to the horizontal plane defined by the pivot axis.

Figure 25:
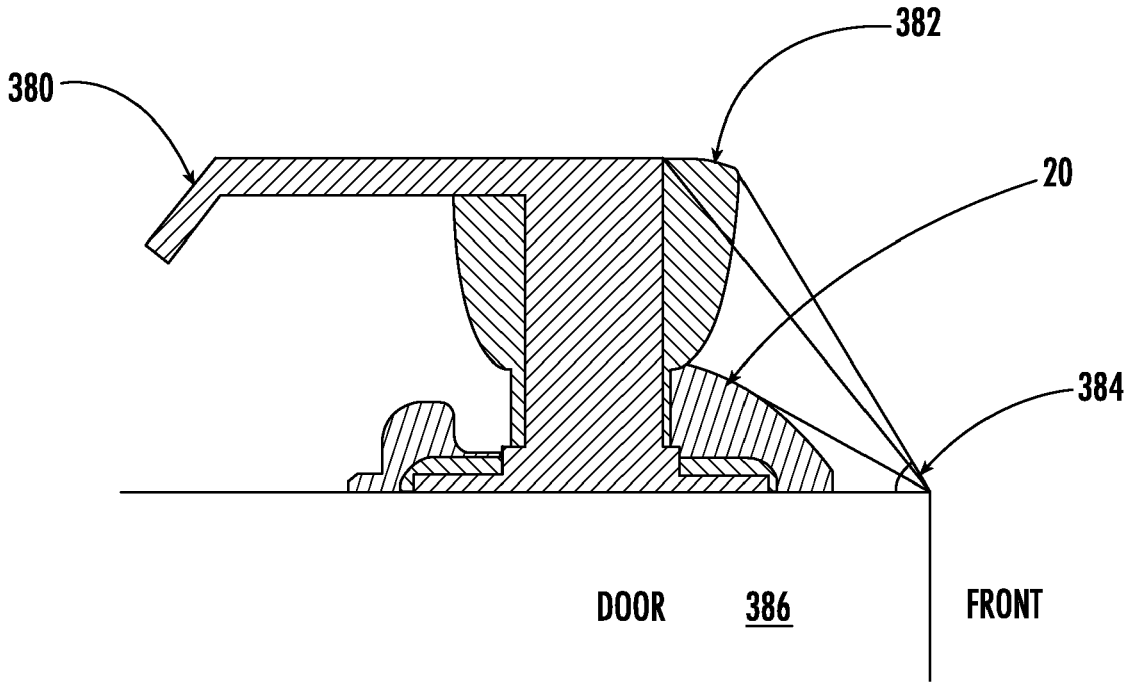
FIG. 25 shows a comparison between the dimensions, including the angles measured from a door surface, of the preferred embodiment of the door handle assembly and the conventional door handle assemblies.

Referring now to FIG. 25, the preferred embodiment of door handle assembly 20 is shown with conventional door handle assemblies 380 and 382. The height of door handle assembly 20 as measured from door 386 is preferably less than the heights of conventional door handle assemblies 380 and 382. Additionally, angle 384 measured from the surface of door 386 to the front surface of door handle assembly 20 is preferably less than those of conventional door handle assemblies 380 and 382.

It can thus be appreciated that certain embodiments of the present invention provide a door handle assembly having a low-profile characteristic. When the door handle assembly of the preferred embodiments shown in FIGS. 24 and 25 is attached to a door and the door is moved toward a wall, the door handle assembly has little or no tendency to contact the wall. Therefore, the door handle assembly of the preferred embodiment minimizes wall damage.

Certain embodiments of the present invention further provide non-rotational actuation feature of the door handle. As shown from the preferred embodiments in FIGS. 24 and 25, the door handle assembly may require a pulling motion. For elderly, physically challenged, persons with wrist problems, and persons carrying objects on both hands, opening a door by a pulling motion may be easier than the conventional rotating motion.

Door Handle

Previously described embodiments have described a door handle that is operated by a pulling motion, no matter which direction the door swings when opened. However, it may be beneficial to provide door handle assemblies where the motion used to actuate the door handle also serves to open the door. For example, a pulling motion may be most useful to operate a door handle when a door will swing inward, towards a person opening the door. A pushing motion may be used to operate a door handle when a door is to swing outward, away from a person opening a door. In this way, opening the door requires less force and operates in a more fluid manner. Such an embodiment may be especially useful for the disabled or for those who are not able to apply large amounts of force to operate a door handle and open a door.

With reference to FIGS. 26-34, a push operated door handle apparatus 400 is shown. Some of the components used in apparatus 400 are the same as previously described in the description of pull operated door handle apparatus 20.

Door handle apparatus 400 can include a bolt plate 80, a frame plate 502, a bolt 476, a bolt collar 72 and a coil spring 78. Bolt 476 comprises a bolt aperture 474 and is adapted to fit into a bolt collar 72 which is mounted in a door. Coil spring 78 biases bolt 476 away from bolt collar 72. Bolt 476 can have a pair of bolt sleeves 520 arranged between bolt collar 72 and bolt 476. Bolt sleeves 520 allow bolt 476 to slide more easily within bolt collar 72. A support block 525 is adapted to fit into bolt aperture 476. Support block 525 reduces wear during actuation of the bolt.

Door handle apparatus 400 may comprise a handle 404 that has ends 404A and 404B. Door handle 404 has projections 410 and 560 that are located toward end 404B. Projection 410 has an aperture 411. Projections 560 have holes 562.

Faceplates 448 and 449 each have a mount 416 that extends away from the faceplate. Faceplates 448 and 449 are mounted on opposite sides of a door (not shown). Mount 416 has parallel projections 418 that extend away from the faceplate. Each parallel projection 418 has a pin opening 422. Projection 410 is adapted to be secured to mount 416.

Mount 416 is shown as a yoke or fork; however other mounts may be used. In certain embodiments, projection 410 can extend into and between parallel projections 418 (only one of which is visible in FIG. 26) of mount 416 and may secured to mount 416 by any suitable means, such as by inserting a pin 419 through hole 411 and pin openings 422 in parallel projections 418. In this manner handle 404 is rotatably connected to faceplate 449.

Similarly, a pull handle 406 can be rotatably mounted to faceplate 448 by pin 438. Pull handle 406 has ends 406A and 406B. An actuator 550 extends away from pull handle 406 toward end 406B. Actuator 550 has an end 551 and a hole 552.

Mount 416 of faceplate 448 also has parallel projections 418. Pin 438 passes through hole 552 and pin openings 422 in parallel projections 418. In this manner handle 406 is rotatably connected to faceplate 448. Pin 438 also supports wire spring 540. Spring 540 biases handle 406 away from faceplate 448.

An actuator 430 may also be attached to mount 416. Actuator 430 has a hole 431 and a projection 470. Actuator 430 may be coupled to mount 416 by any suitable means, such as by inserting a pin 436 or other suitable fastener into pin openings 440 and 442 in parallel projections 418 and hole 431 in actuator 430, respectively. Mount 416 may be integrally formed on a faceplate 449 or may be coupled to faceplate 449 by any suitable means, such as by welding or adhesives. Pin 436 also supports wire spring 542. Spring 542 biases handle 404 away from faceplate 449.

Projections 560 of door handle 404 may also have a roller or linkage 454 coupled thereto. Roller 454 may be a ball bearing, a bicycle chain roller, a metal roller, or a roller constructed of other materials, including rubbers, plastics, and the like. In certain embodiments, such as the one depicted in FIG. 26, roller 454 may rotate about a vertical axis. Roller 454 may rest against a curved surface 460 of actuator 430. Roller 454 may be attached to, and rotate around, a pin 462 of handle 404. Pin 462 passes through holes 562 and roller 454. Roller 454 may be attached to door handle 404 in other ways without departing from the scope of the present invention.

Figure 28:
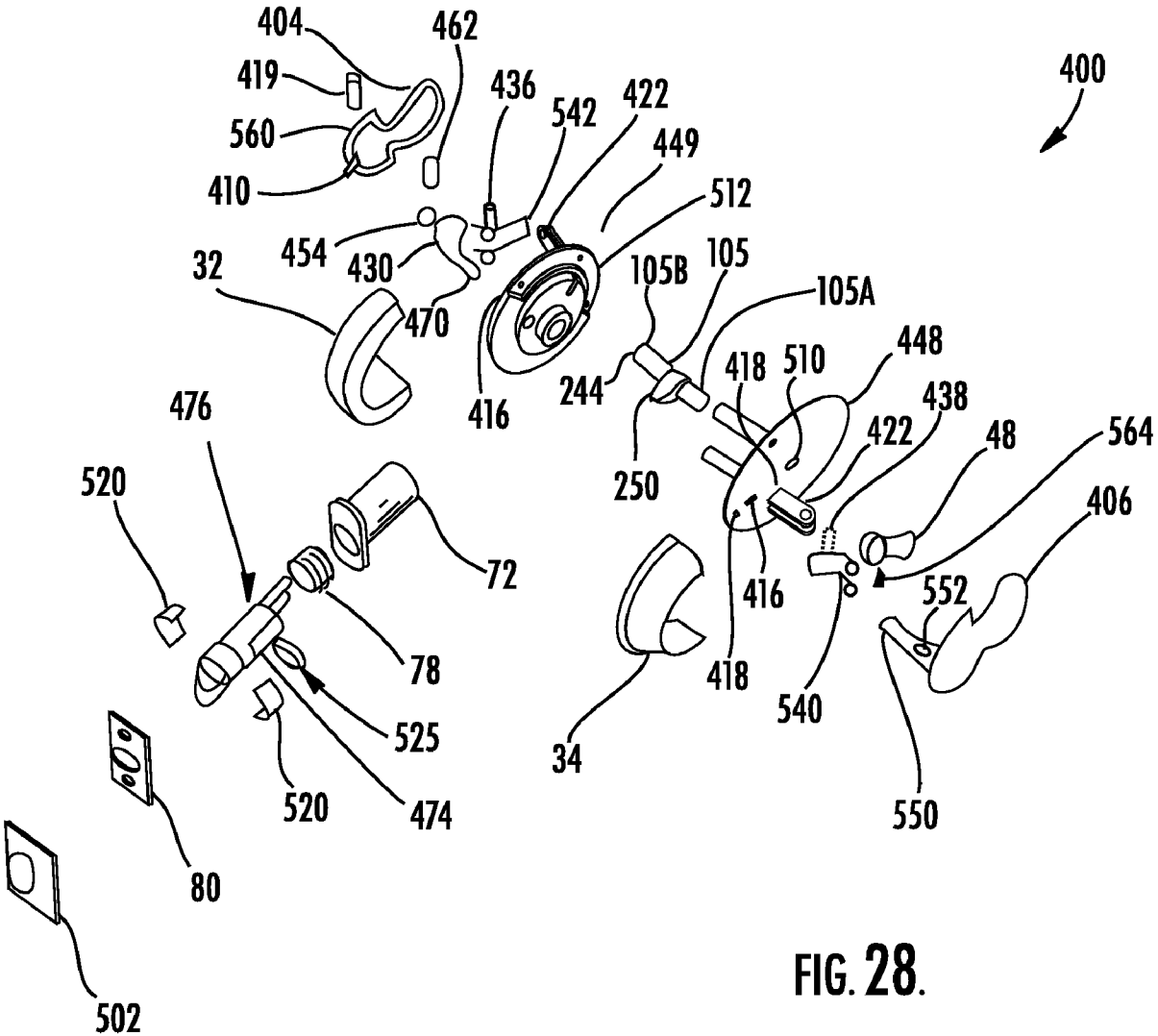
FIG. 28 is substantially an exploded view of the door handle assembly of FIG. 26.
Figure 30:
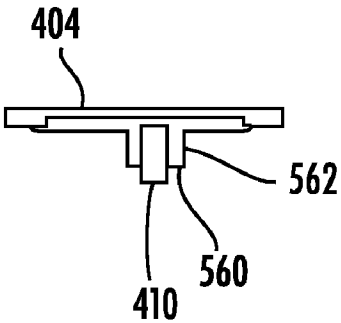
FIG. 30 is substantially a side view of the handle of FIG. 28.
Figure 29:
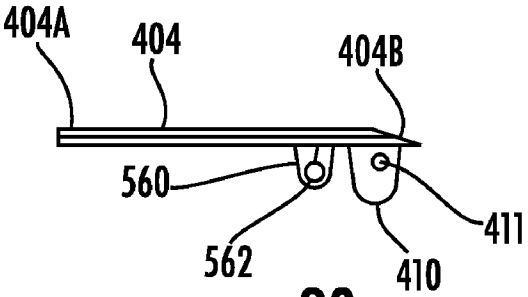
FIG. 29 is substantially a top view of the handle of FIG. 28.
Figure 31:
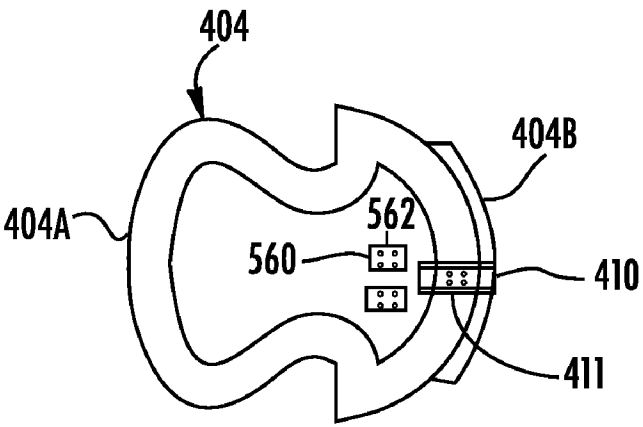
FIG. 31 is substantially a rear view of the handle of FIG. 28.
Figure 33:
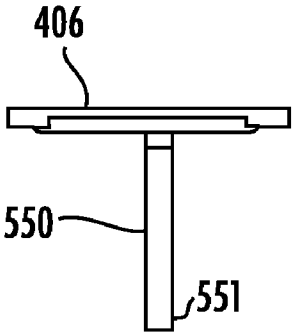
FIG. 33 is substantially a side view of the handle of FIG. 28.
Figure 32:
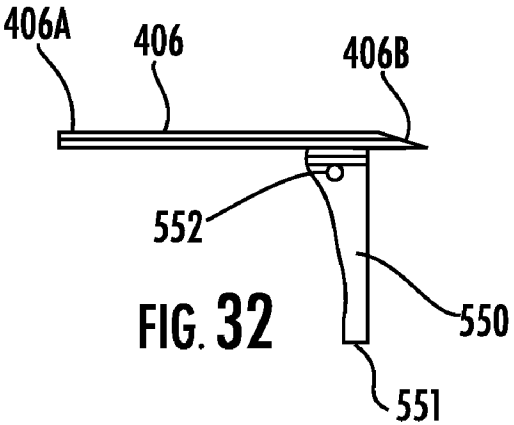
FIG. 32 is substantially a top view of the handle of FIG. 28.
Figure 34:
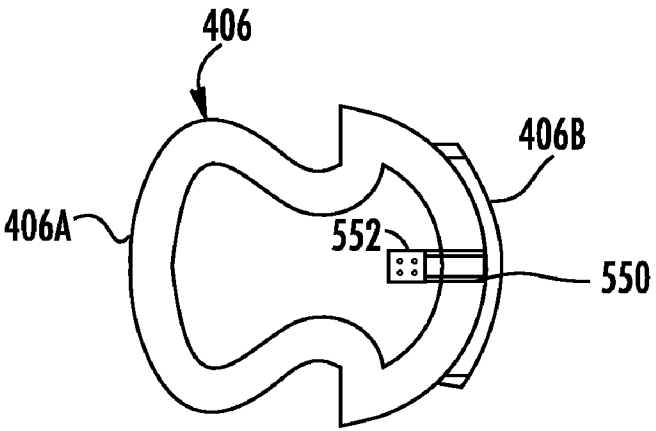
FIG. 34 is substantially a rear view of the handle of FIG. 28.

Referring now to FIG. 28, door handle assembly 400 may further include a cam assembly 105. Cam assembly 105 is rotatably supported and mounted between faceplates 448 and 449. Faceplate 448 has a hole 510 and faceplate 449 has a hole 512. Cam assembly 105 has an end 105A, an end 105B and a raised abutting portion 250. End 105A extends through hole 510 and end 105B extends through hole 512. Further details of cam assembly 105 are shown in FIG. 16. Can assembly 105 includes a cam portion 240 and a cam shaft 242. Turning back to FIG. 28, cam assembly 105 is shaped to fit with bolt 476 so as to lock the door. Raised abutting portion 250 is adapted to abut bolt 476 and prevent the bolt from sliding away from the frame plate 502 thereby locking the door.

A cam latch 48 can be secured to end 105A through the use of set screw 564. When cam latch 48 is rotated in one direction, raised abuting portion 250 prevents movement of bolt 476. Cam assembly 105 can further operate as previously described. An alternate cam access 244 can be mounted to end 105B. Alternate cam access 244 can be a depression that allows a flathead screwdriver or key to rotate cam assembly 105.

Figure 26:
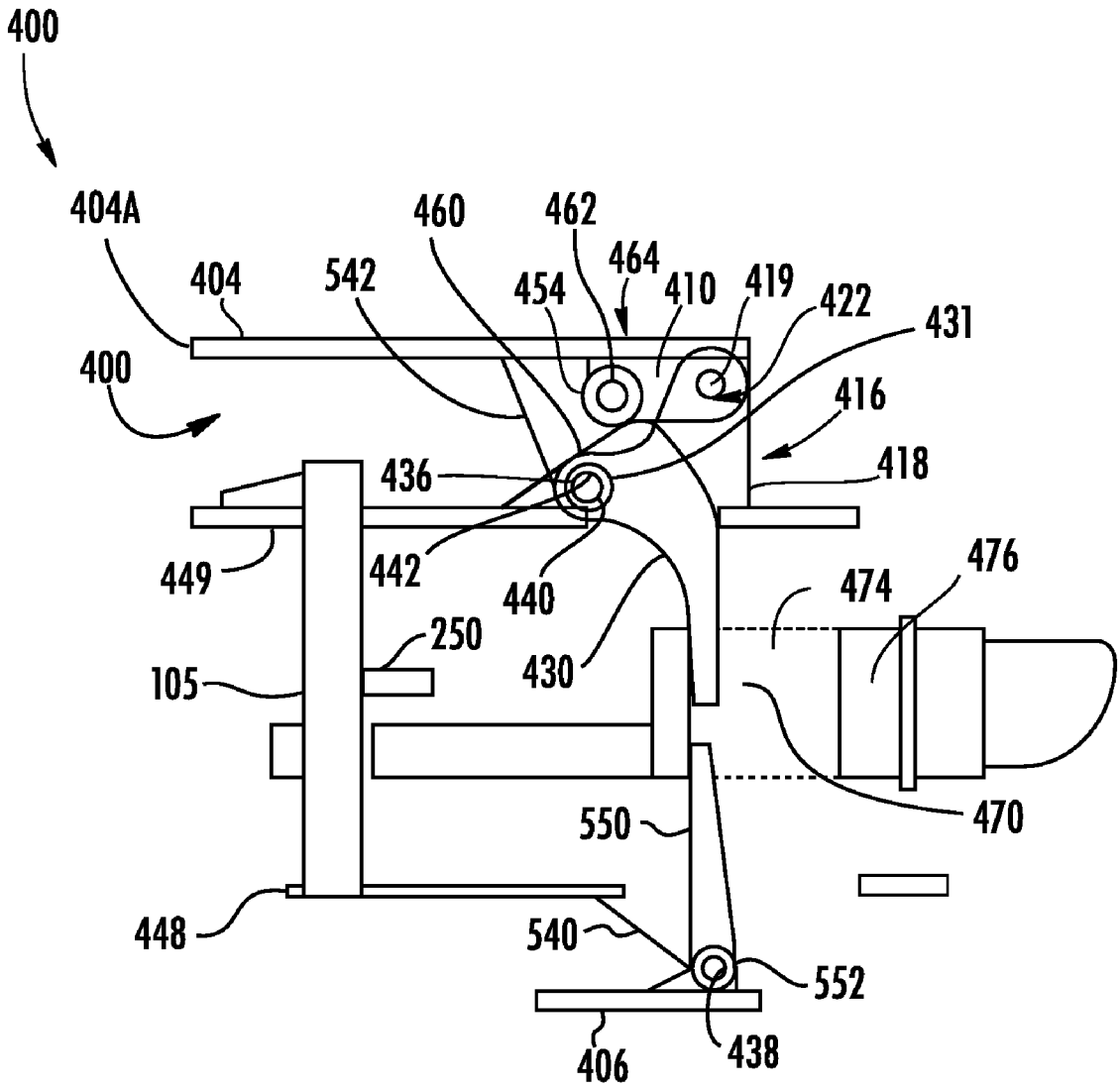
FIG. 26 is substantially a top partial cutaway view of an alternative door handle assembly according to the present invention.
Figure 27:
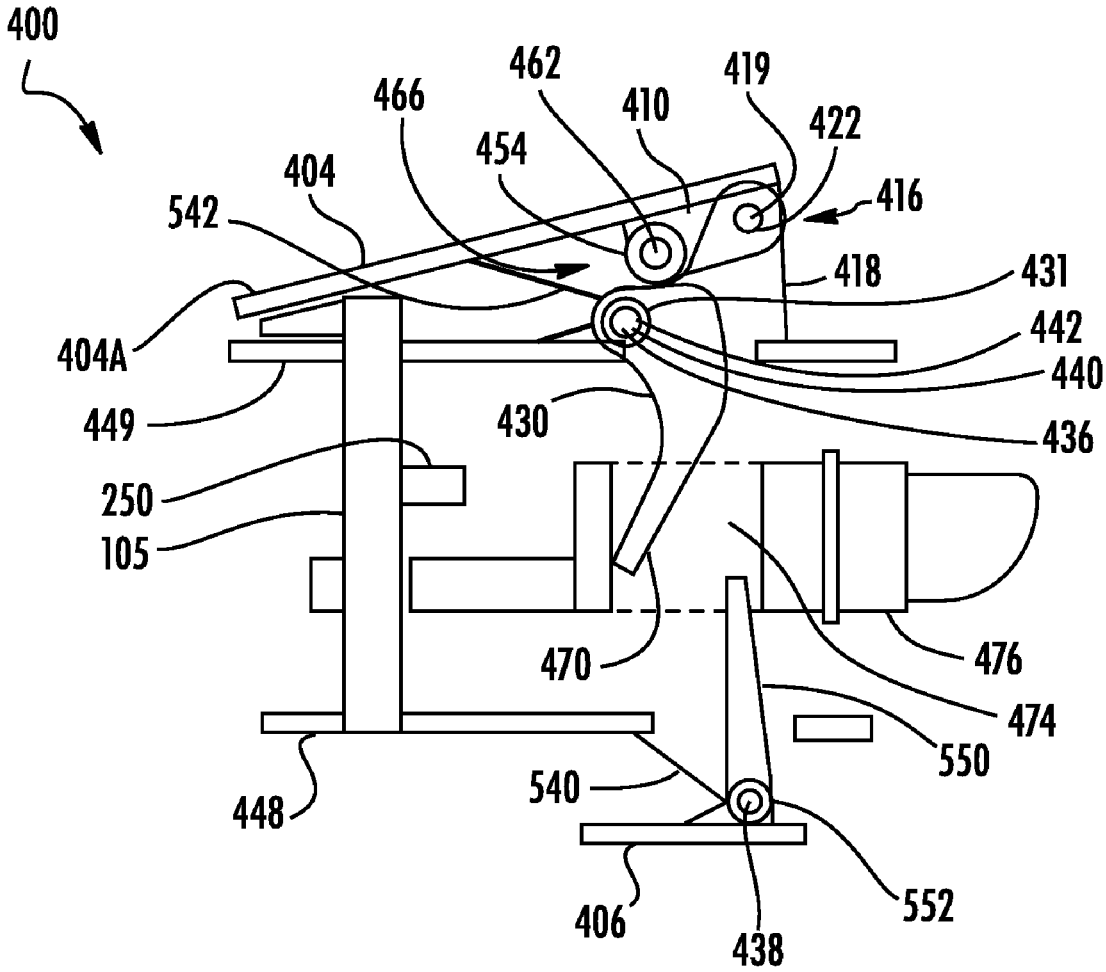
FIG. 27 is substantially a top partial cutaway view of the door handle assembly of FIG. 26 wherein the door handle has been pushed.

With reference now to FIGS. 26 and 27. When the door handle assembly 400 is not being actuated, roller 454 may rest at a first position 464 on actuator 430. When handle 404 is pushed, roller 454 will travel along surface 460 of actuator 430, eventually reaching a second position 466, shown in FIG. 27. Referring back to FIG. 26, during operation, force will be transmitted from handle 404, through roller 454, to actuator 430. As roller 454 moves, the transmitted force will cause force to be applied to actuator 430 in different directions, causing actuator 430 to move. At the same time handle 404 will pivot about pin 419 with handle end 404A moving toward faceplate 449. A projection 470 of actuator 430 passes into actuator opening 474 formed in a bolt 476. As roller 454 moves from first position 464 to second position 466, projection 470 of actuator 430 will engage a portion of the interior of bolt 476 towards the interior of a door (not shown in FIG. 26), causing bolt 470 to be retracted away from a wall aperture in a wall (not shown in FIG. 26).

Bolt 470 may be biased towards the frame plate by spring 78. When force is no longer applied to door handle 404, springs 78 and 542 will cause bolt 470 to be biased towards the frame plate 502, in turn causing roller 454 to move from second position 466 back to first position 464 and handle 404 to move away from faceplate 449 back to an undepressed position.

Figure 35:
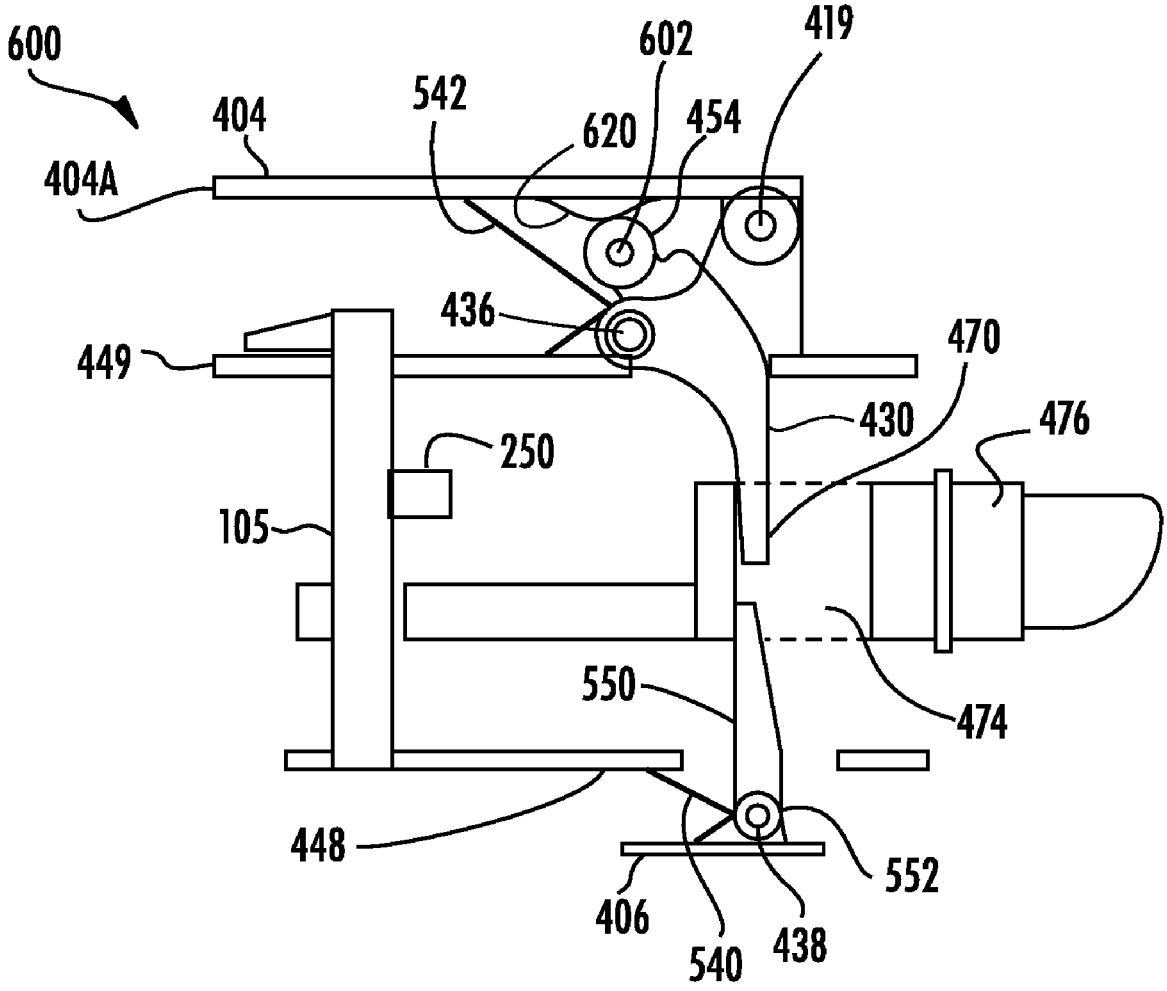
FIG. 35 is substantially a top partial cutaway view of another embodiment of the door handle assembly wherein the door handles are generally at rest.
Figure 36:
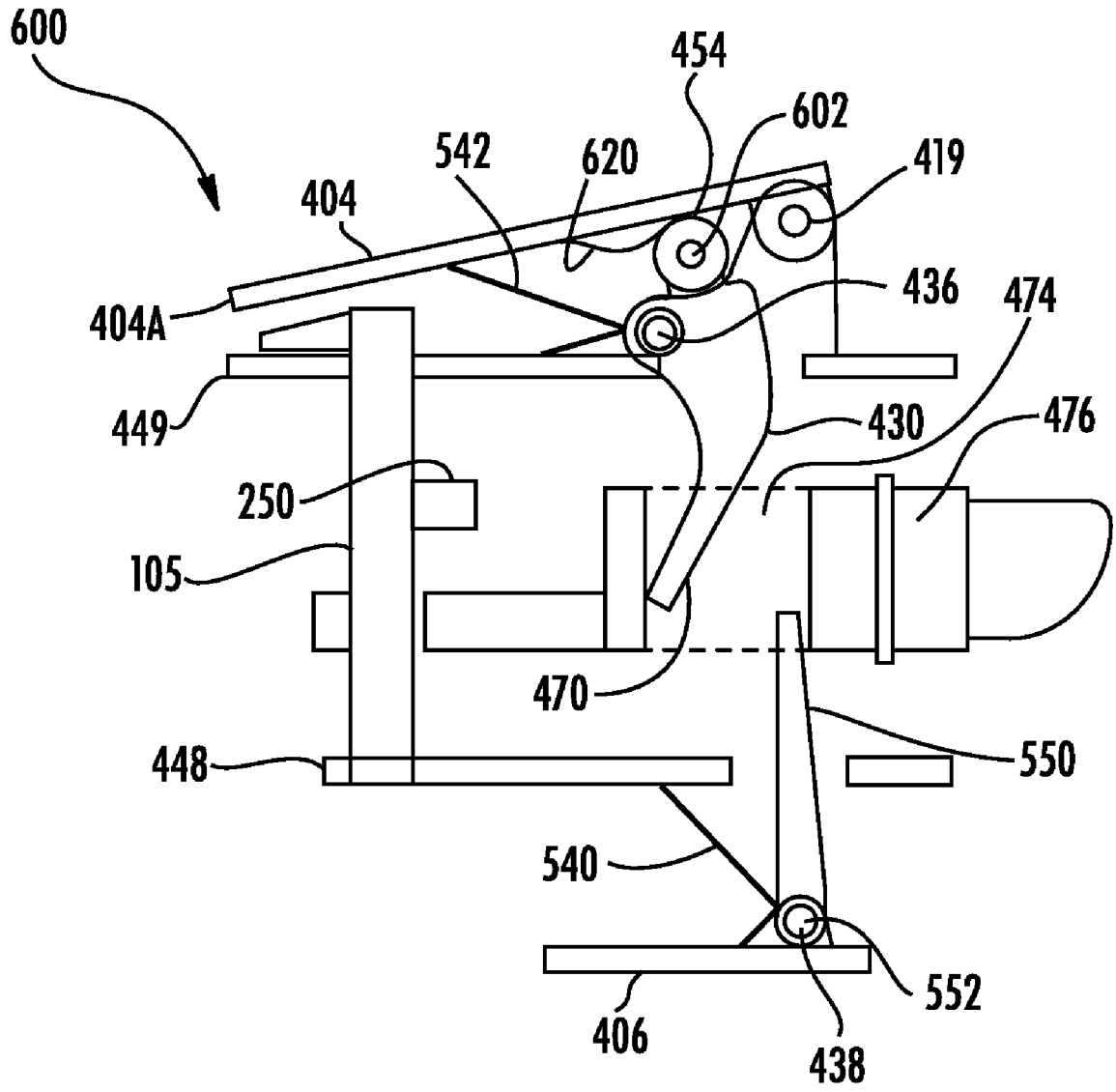
FIG. 36 is substantially a top partial cutaway view of the handle assembly of FIG. 35 wherein a door handle is depressed.

The present invention is not limited by the position of roller 454 or curved surface 460. For example, as shown in FIGS. 35 and 36 another embodiment of a push door handle assembly 600 is shown. Push door handle assembly 600 can have a roller 454 that is mounted on actuator 430 using pin 602. Curved surface 620 may be on door handle 404. Operation of this embodiment is analogous to that of the door handle assembly 400 previously described in FIGS. 26 and 27.

With reference now to FIGS. 26 and 27, the door can also be opened by the use of pull handle 406. Pull handle 406 can operate the same as previously described for door handle assembly 20. Pull handle 406 is rotatably mounted to faceplate 448 by pin 438. Actuator 550 has an end 551 that extends into bolt aperture 476. Pulling on handle 406 causes bolt 476 to retract allowing opening of the door.

The components of door handle assembly 400 may be used with any previously described door handle assemblies, or with other door handle assemblies now existing or later developed, that are within the knowledge of one skilled in the art. In certain embodiments, a door handle assembly may be configured so that it has push handles on both sides of the door handle assembly.

Conclusion

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A door handle assembly comprising:

(A) a door handle, the door handle having a roller;

(B) a mount, the door handle being attached to the mount;

(C) an actuator, the actuator attached to the mount by a fastener, the actuator having a first surface and an actuator projection, the actuator being configured to rotate around the fastener;

(D) a bolt, the bolt being movable from a first bolt position where at least a portion of the bolt is inside a wall aperture thereby engaging a door into the wall aperture to a second bolt position where the portion of the bolt is outside the wall aperture thereby disengaging the door from the wall aperture, the bolt having an actuator opening formed therein, the actuator projection passing into the actuator opening, wherein the roller abuts the first surface and may travel from a first roller position to a second roller position when the door handle is pushed, thereby retracting the bolt from the first bolt position to the second bolt position; and (E) a cam assembly disposed adjacent to the bolt, the cam assembly including a cam attached on a cam shaft, the cam being adapted to abut at least a portion of the bolt, wherein when the cam is actuated, the cam is adapted to lock the bolt in the first bolt position.

2. The door handle assembly of claim 1, wherein the cam assembly further comprises a cam latch attached at one end of the cam shaft, the cam latch being adapted to allow a user to actuate the cam.

3. The door handle assembly of claim 2, further comprising an alternative cam access attached to the end of the cam shaft opposite to the cam latch, the alternative cam access being adapted to allow the user to actuate the cam from a side opposite the cam latch.

4. The door handle assembly of claim 1, further comprising a pull door handle assembly located on an opposite side of the door as the door handle.

5. The door handle assembly of claim 4, wherein the pull door handle assembly includes a second actuator that is adapted to extend into the actuator opening.

6. A door handle assembly comprising:

(A) a door handle, the door handle having a first surface;

(B) a mount, the door handle being attached to the mount;

(C) an actuator, the actuator attached to the mount by a fastener, the actuator having a roller and an actuator projection, the actuator being configured to rotate around the fastener;

(D) a bolt, the bolt being movable from a first bolt position where at least a portion of the bolt is inside a wall aperture thereby engaging a door into the wall aperture to a second bolt position where the portion of the bolt is outside the wall aperture thereby disengaging the door from the wall aperture, the first and the second bolt position defining a sliding axis, the bolt having an actuator opening formed therein, the actuator projection passing though the actuator opening, wherein the roller abuts the first surface and may travel from a first roller position to a second roller position when the door handle is pushed, thereby retracting the bolt from the first bolt position to the second bolt position; and (E) a cam assembly disposed adjacent the bolt, the cam assembly including a cam attached on a cam shaft, the cam being adapted to abut at least a portion of the bolt, wherein when the cam is actuated, the cam is adapted to lock the bolt in the first bolt position.

7. The door handle assembly of claim 6, wherein the cam assembly further comprises a cam latch attached at one end of the cam shaft, the cam latch being adapted to allow a user to actuate the cam.

8. The door handle assembly of claim 6, further comprising an alternative cam access attached to the end of the cam shaft opposite to the cam latch, the alternative cam access being adapted to allow the user to actuate the cam from a side opposite the cam latch.

9. The door handle assembly of claim 6, further comprising a pull door handle assembly located on an opposite side of the door as the door handle.

10. The door handle assembly of claim 9, wherein the pull door handle assembly includes a second actuator that is adapted to extend into the actuator opening.

11. A door assembly comprising:

(A) door handle means for opening and closing a door;

(B) bolt means for selectively engaging a door frame, the bolt means being movable from a first bolt position where the bolt means engages a door frame aperture to a second bolt position where the bolt means is retracted from the door frame aperture;

(C) actuator means for selectively engaging the bolt means;

(D) mounting means for operatively coupling the door handle means to the actuator means and fastener means for rotatably attaching the actuator means to the mounting means;

(E) roller means for transferring force from the door handle means to the bolt means, wherein the roller means is coupled to the door handle means; and (F) surface means for transferring force from the door handle means to the bolt means, wherein the surface means is formed on the actuator means, the roller means abutting the surface means and being moveable from a first roller position when the door handle means is not actuated to a second roller position when the door handle means is pushed.

12. The door assembly of claim 11, wherein the roller means is coupled to the actuator means and the surface means is formed on the door handle means.

13. The door assembly of claim 11, wherein the fastener means includes securely coupling the door handle means to the mounting means.

14. The door assembly of claim 11, fun her comprising a biasing means for biasing the bolt means toward the first bolt position.

15. The door handle assembly of claim 11, further comprising pull door handle means for moving the bolt means when the pull door handle means is pulled, the pull door handle means located on an opposite side of the door as the door handle means.

* * * * *